US009970731B2

(12) United States Patent
Horn

(10) Patent No.: US 9,970,731 B2
(45) Date of Patent: May 15, 2018

(54) ARCHERY RELEASE DEVICE HAVING SLIDE ADJUSTABILITY FOR A SUPPORT OF A BOWSTRING HOLDER

(71) Applicant: Scott Archery, LLC, Clay City, KY (US)

(72) Inventor: Charles E. Horn, Cedar Rapids, IA (US)

(73) Assignee: Scott Archery LLC, Clay City, KY (US)

( * ) Notice: Subject to any disclaimer, the term of this patent is extended or adjusted under 35 U.S.C. 154(b) by 0 days. days.

(21) Appl. No.: 15/609,189

(22) Filed: May 31, 2017

(65) Prior Publication Data

US 2017/0261284 A1 Sep. 14, 2017

Related U.S. Application Data

(63) Continuation of application No. 15/281,901, filed on Sep. 30, 2016, now Pat. No. 9,702,658.

(60) Provisional application No. 62/234,785, filed on Sep. 30, 2015, provisional application No. 62/330,327, filed on May 2, 2016.

(51) Int. Cl.
*F41B 5/18* (2006.01)
*F41B 5/14* (2006.01)

(52) U.S. Cl.
CPC ..... *F41B 5/1469* (2013.01)

(58) Field of Classification Search
CPC ..... F41B 5/1469
See application file for complete search history.

(56) References Cited

U.S. PATENT DOCUMENTS

| | | | |
|---|---|---|---|
| 5,653,214 | A | 8/1997 | Lynn |
| 5,666,936 | A | 9/1997 | Estrada |
| 6,571,786 | B2 | 6/2003 | Summers et al. |
| 6,945,241 | B2 | 9/2005 | Pellerite |
| 8,402,957 | B1 | 3/2013 | Clark |
| 8,746,223 | B2 | 6/2014 | Jones |
| 8,997,729 | B1 | 4/2015 | Gillig |
| 2011/0168146 | A1 | 7/2011 | Deceuster |
| 2016/0195359 | A1 | 7/2016 | Trpkovski |
| 2017/0089663 | A1 | 3/2017 | Horn |

OTHER PUBLICATIONS

U.S. Appl. No. 15/281,982, filed Sep. 30, 2016.
"TruBall Releases," T.R.U. Ball Archery, Sep. 10, 2015; retrieved from the Internet: <web.archive.org/web/20150906083915/http://www.truball.com>, 3 pages.
Carter Enterprises; 2 Moons web page; Aug. 22, 2015; 1 page.
Carter Entrprises; 2 Moons Instructions; Aug. 22, 2015, 1 page.

*Primary Examiner* — John Ricci
(74) *Attorney, Agent, or Firm* — Barclay Damon LLP

(57) ABSTRACT

An archery release device has, in an embodiment, a body, a base, a support, a bowstring holder and a driver. The base is pivotally coupled to the body, and the support holds or supports the bowstring holder. The bowstring holder is pivotally coupled to the support. The support is configured to be slid relative to the base in response to an action of the driver.

20 Claims, 21 Drawing Sheets

ARCHERY RELEASE DEVICE HAVING SLIDE ADJUSTABILITY FOR A SUPPORT OF A BOWSTRING HOLDER

CROSS-REFERENCE TO RELATED APPLICATIONS

This application is a continuation of, and claims the benefit and priority of, U.S. patent application Ser. No. 15/281,901 filed on Sep. 30, 2016, which is a non-provisional of, and claims the benefit and priority of: (i) U.S. Provisional Patent Application No. 62/234,785 filed on Sep. 30, 2015; and (ii) U.S. Provisional Patent Application No. 62/330,327 filed on May 2, 2016. The entire contents of such applications are hereby incorporated by reference.

BACKGROUND

Archery bows are designed to accommodate a specific range of human factors, including the user's arm span. Arm span is associated with the bow's draw length. A user can determine his/her personal draw length using various methods. One method involves measuring his/her arm span and dividing that measurement by 2.5. Once the user knows his/her personal draw length, the user can purchase a bow designed to accommodate such draw length. However, users often have the need for various draw lengths. For example, a single user may use different bows with slightly different draw lengths. Also, a single user may need different draw lengths to achieve a consistent anchor point on the user's face regardless of variables that affect the draw length, such as the particular bow used or the bowstring angle. In another example, a user may prefer a relatively short draw length for shooting events requiring greater shooting form and accuracy, and the same user may prefer a relatively long draw length for shooting events requiring greater speed. Also, if a user is still growing, such as a child, his/her draw length can significantly increase from time to time, requiring changes in draw length. Furthermore, a parent may wish to purchase a single bow for multiple children having substantially different arm spans, requiring substantially different draw lengths. In each of these scenarios, to significantly change draw length, users must purchase multiple bows or multiple release accessories resulting in a substantial cost, or users must undergo labor-intensive tasks to modify the cams or components of their original bows.

There is a known bowstring release accessory which enables the user to adjust the draw length as a possible alternative to changing bows. This release accessory has a two-part grip, a bar connected to the grip, and a hook connected to the bar. The bar has a fixed quantity of holes used to connect the grip parts to the bar. To set a different draw length, the user must disassemble the two grip parts from the bar, choose a different hole for connecting to the grip parts, and reassemble the grip parts and bar.

This known bowstring release accessory has several disadvantages and problems. The disassembly and reassembly processes are burdensome and cumbersome due, in part, to the need to separate the grip parts and then reunite them. Also, the bar has a fixed and limited quantity of holes permanently formed in the bar. This limitation prevents certain users from making minor, controlled adjustments of the draw length to closely accommodate the users' arm spans. Also, for a user with relatively short arms, for example, the limited quantity of holes may not be sufficient to set the appropriate draw length. Furthermore, the hole arrangement causes looseness within the release. This is because this release has a fastener which is inserted into the selected hole. There is a gap between the fastener's diameter and the hole's diameter. This gap, which extends along the shooting axis, creates internal looseness. In the transition from pre-release to release, the fastener can move within this gap. This movement can decreases the responsiveness and sensitivity of this release accessory, and it can cause a ratchety or jerky operation of this release accessory. These shortcomings can hinder the user's control of this known release accessory and can also impair the user's shooting performance.

Furthermore, the known bowstring release accessories are not designed to provide user-friendly ways to adjust the release sensitivity in a micro-controlled fashion.

The foregoing background describes some, but not necessarily all, of the problems, disadvantages and challenges related to accommodating draw length variations in archery and adjusting the release sensitivity of archery releases.

SUMMARY

The archery release device, in an embodiment, includes a body having a plurality of finger engagers. The finger engagers have an index finger valley, a middle finger valley, and a peak between the index finger and middle finger valleys. The peak defines a channel extending through the body. The archery release device also includes a neck configured to be inserted through the channel. The neck has a forward end and a rearward end located opposite of the forward end. The neck is configured to be moved from a first position on an adjustment axis, to a second position on the adjustment axis. The adjustment axis extends toward a target when the archery release device is aimed at the target. The archery release device also includes a head coupled to the forward end. The head has a hook configured to engage a bowstring. The hook is configured to pivot relative to the body. In addition, the archery release device includes a position regulator coupled to the neck. When the neck is in the second position, the position regulator is configured to secure the neck in the second position and exert a securing force on the neck to impede movement of the neck along the adjustment axis. The securing force acts along the adjustment axis.

In another embodiment, the archery release device includes a body having a plurality of finger engagers. The finger engagers have an index finger engager and a middle finger engager spaced apart from the index finger engager. The body defines a pass-through opening. The archery release device also includes a neck configured to be inserted through the pass-through opening. The neck has a forward end and a rearward end located opposite of the forward end. The forward end of the neck is configured to be translated from a first position relative to an adjustment axis, to a second position relative to the adjustment axis. The adjustment axis intersects with a target plane when the archery release device is aimed at a target. In addition, the archery release device includes a head coupled to the neck. The head has a bowstring engager configured to engage a bowstring, and the head has a position regulator. The position regulator is configured to secure the forward end in the second position by applying a securing force to the neck. The securing force acts along the adjustment axis.

Yet another embodiment includes a method for manufacturing an archery release device operable to generate a plurality of different draw lengths for an archery bow. The archery bow is configured to be aimed toward a target which extends upward in a plane. The method includes the following steps in the order listed or in a different order:

fabricating a body comprising a plurality of finger engagers, wherein the finger engagers include an index finger engager and a middle finger engager spaced apart from the index finger engager;

forming an opening entirely through the body;

fabricating a neck configured to be inserted through the opening, wherein: (a) the neck has a forward end and a rearward end located opposite of the forward end; (b) the forward end of the neck is configured to be translated from a first position relative to an axis, to a second position relative to the axis; and (c) the axis intersects with the plane;

fabricating a head coupled to the neck, wherein the head has a bowstring engager configured to engage a bowstring, wherein the bowstring is operable to launch a projectile toward the plane; and fabricating a position regulator configured to secure the forward end in the second position so that, when the position regulator is coupled to the neck, the position regulator asserts a force on the neck, wherein the force acts along the axis to decrease any movement between the neck and the body when the forward end is in the second position.

Additional features and advantages of the present disclosure are described in, and will be apparent from, the following Brief Description of the Drawings and Detailed Description.

DETAILED DESCRIPTION

Figure 1:
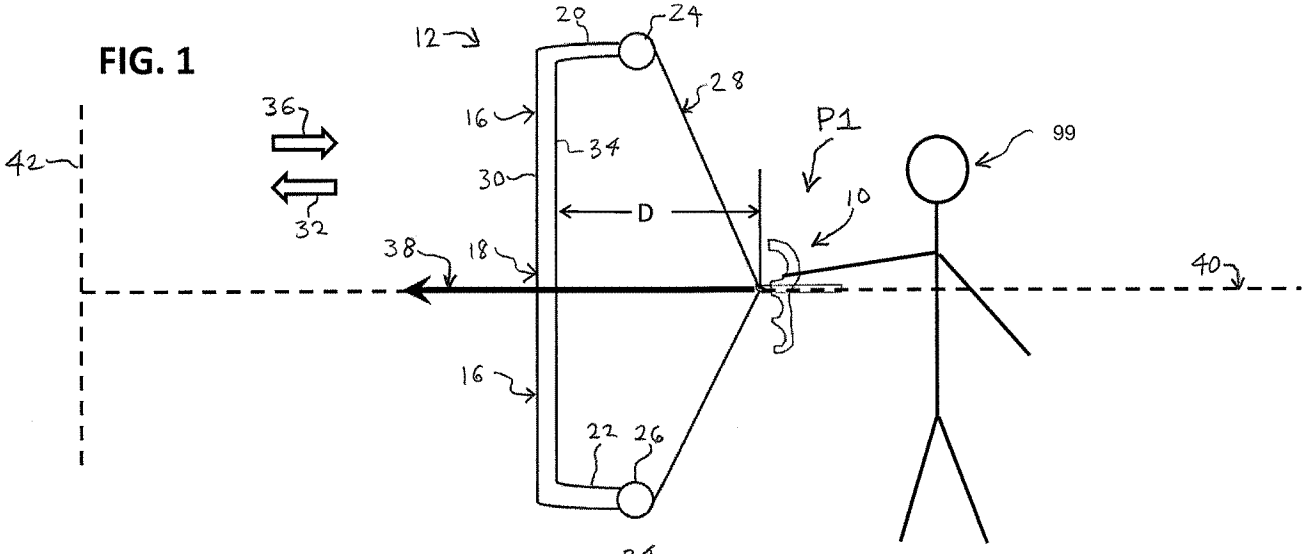
FIG. 1 is a schematic diagram of an embodiment of the archery release device used with an archery bow having a draw length suitable for a first user.

As illustrated in FIG. 1, the archery release device 10, in an embodiment, is usable with a plurality of different archery bows, such as archery bow 12. In the illustrated example, archery bow 12 includes: (a) a main branch or riser 16 having a handle portion 18; (b) a plurality of flexible limbs 20, 22 coupled to the riser 16; (c) a plurality of rotors 24 and 26 (e.g., wheels, pulleys or cams) which are rotatably coupled to the limbs 20 and 22, respectively; (d) a draw string or bowstring 28 coupled to the rotors 24, 26; and (e) one or more power cables (not shown) coupled to the rotors 24, 26. The riser 16 has a front 30 facing in a forward direction 32 toward a target (not shown) and a back 34 facing in a rearward direction 36 toward the user. Archery bow 12 is operable to launch a projectile 38 (e.g., an arrow) in the forward direction 32 along a shooting axis 40 toward a target (e.g., an animal, target board or target paper) which extends upward in a target plane 42.

Figure 3:
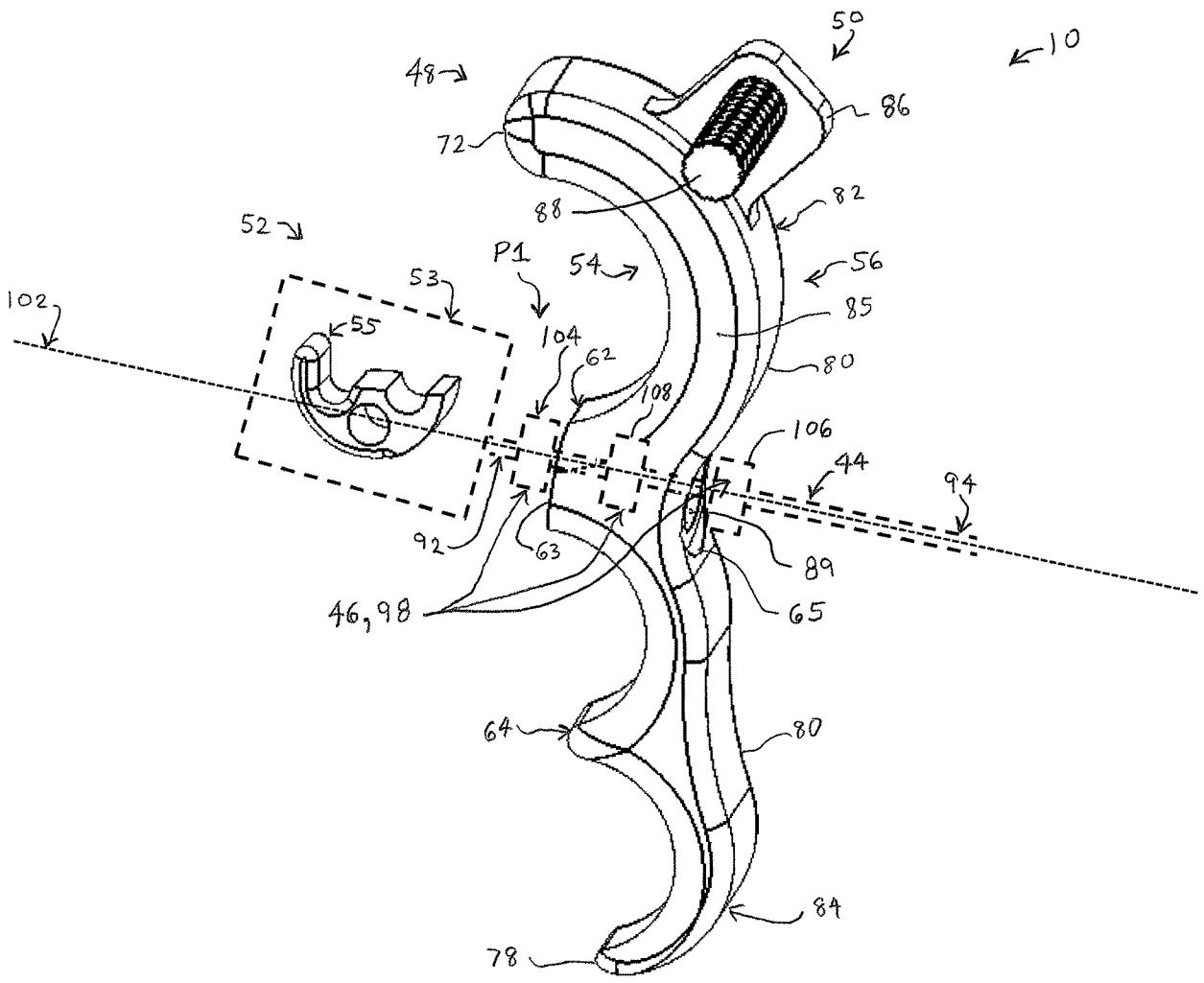
FIG. 3 is a right isometric view of an embodiment of an archery release device illustrated in a first position.
Figure 4:
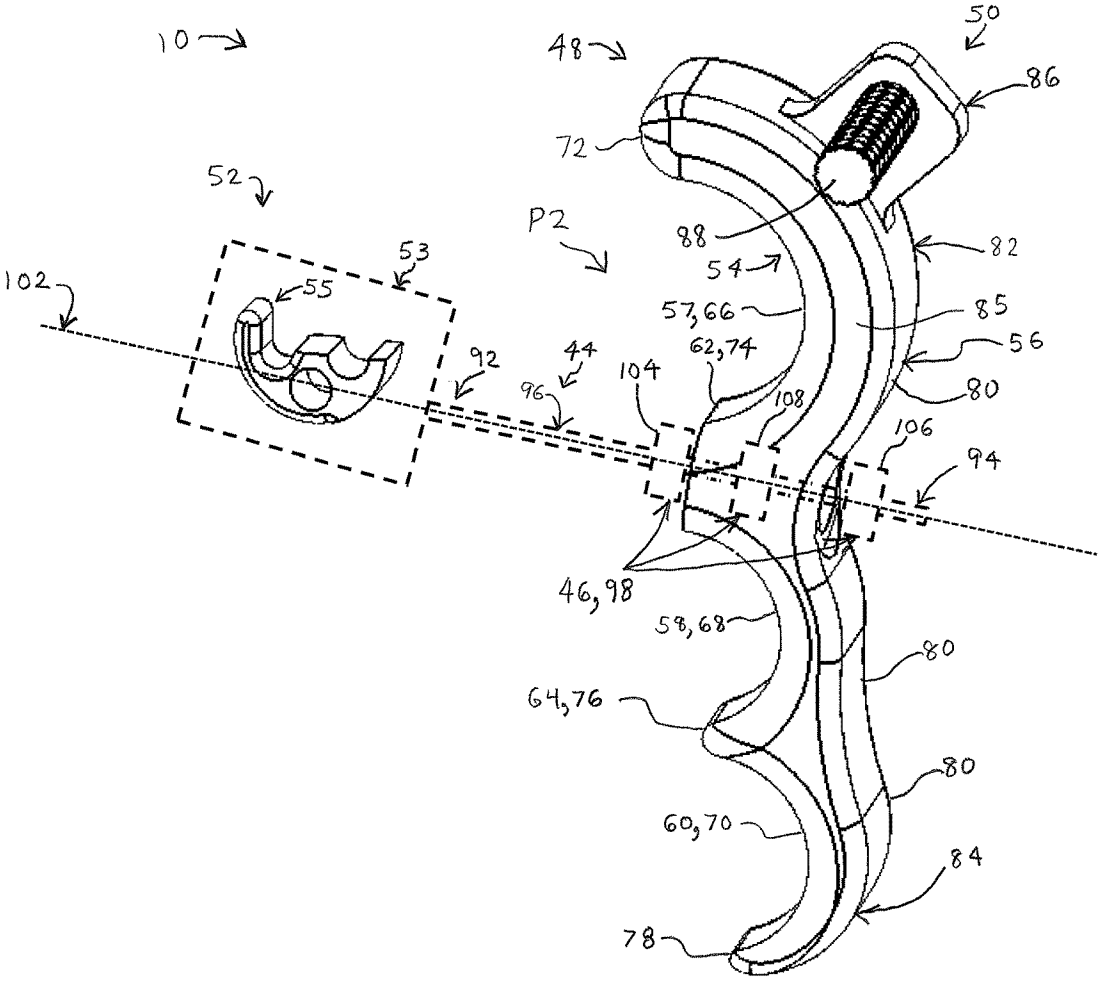
FIG. 4 is a right isometric view of the archery release device of FIG. 3 illustrated in a second position.

As illustrated in FIGS. 3-4, in an embodiment, the archery release device 10 is a triggerless, handheld release (e.g., a back tension handheld release). This type of archery release device 10 is configured to be held in the user's palm and has regions for ergonomic engagement with two or more or all of the user's fingers. In an embodiment, to cause the archery release device 10 to release the bowstring 28, the user flexes or tenses his/her back muscles while the archery release device 10 is hooked onto the retracted bowstring 28. The back muscle action causes a slight, abrupt jerk, twist or pull on the archery release device 10 which causes the archery release device 10 to release the bowstring 28, as described below. Accordingly, in an embodiment, the archery release device 10 does not include a trigger, release button, release switch or other touch-responsive release controller to cause the archery release device 10 to release the bowstring 28. Therefore, the archery release device 10 does not rely upon or require the user to depress, slide, touch or move any release controller to release the bowstring 28.

It should be appreciated, however, that in other embodiments, certain components of the archery release device 10, such as the neck 44 and position regulator 46, are incorporated into other types of archery releases, such as: (a) trigger-based, handheld release devices which include a trigger, release button, release switch or other touch-responsive release controller to cause the release device to release the bowstring; or (b) a wrist-harnessed release device. In an embodiment, the wrist-harnessed release device includes: (a) a harness or strap attachable to the user's wrist; (b) an arm connected to the strap; (c) a movable jaw coupled to the arm; and (d) a trigger or slider connected to the jaw for opening the jaw to release the bowstring.

Referring to FIGS. 1-4, in an embodiment, the archery release device 10 includes: (a) a body 48 (e.g., a handle, grasp or grip); (b) a thumb rest or thumb support 50 connected to the body 48; (c) the neck 44 (e.g., an extension or elongated reach member) movably coupled to the body 48; (d) a head 52 coupled to the neck 44; and (e) the position regulator 46 coupled to the neck 44.

The body 48 has a front side 54 configured to face in the forward direction 32 and a back side 56 located opposite of the front side 54. The front side 54 has: (a) a plurality of finger engagement surfaces or finger engagers, including index finger engager 57, middle finger engager 58 and ring finger engager 60; and (b) a plurality of finger separation surfaces or finger separators, including finger separators 62, 64. In the illustrated embodiment, the front side 54 has a wavy shape defining a plurality of valleys 66, 68, 70 and a plurality of peaks 72, 74, 76, 78.

The back side 56 has a palm engagement surface or palm engager 80 extending from the upper region 82 to the lower region 84 of the archery release device 10. In the illustrated embodiment, the body 48 is a unitary member having a one-piece structure. It should be appreciated that in other embodiments, the body 48 includes a plurality of separable components. For example, the body 48 can have a right side 85 (FIG. 3) which is removably attachable to a left side (not shown) located opposite of the right side 85. One or more screws or other suitable fasteners can be used to connect the right side 85 to such left side. The body 48, whether unitary or formed of multiple components, defines a body opening 89 (e.g., a pass-through opening, passageway, tunnel or channel) which passes entirely through the body 48, extending from the front side 54 through the back side 56. In the illustrated embodiment, the front side 54 has a front separator surface 63 defining the front access to the body opening 89, and the back side 56 has a back separator surface 65 defining the back access to the body opening 89. The body opening 89 extends entirely through the finger separator 62.

Figure 9:
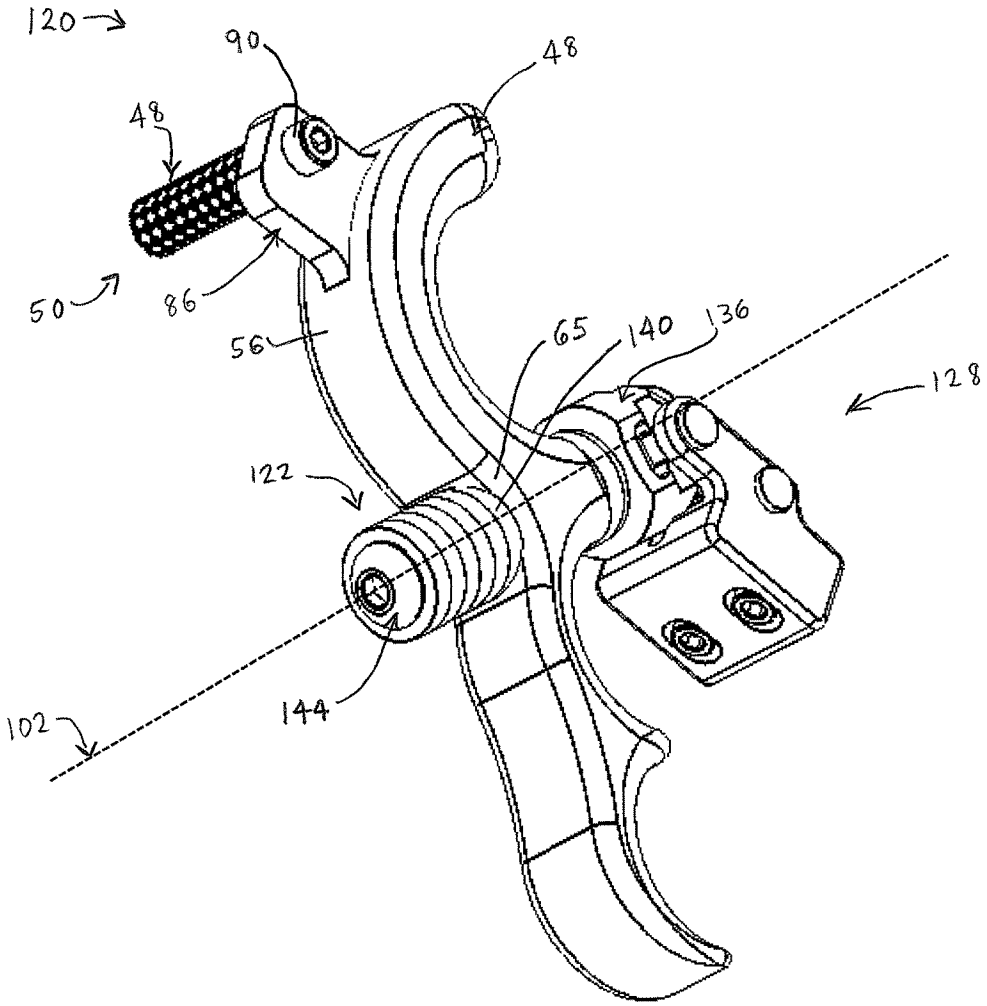
FIG. 9 is a rear isometric view of the archery release device of FIG. 7 illustrated in the first position.
Figure 10:
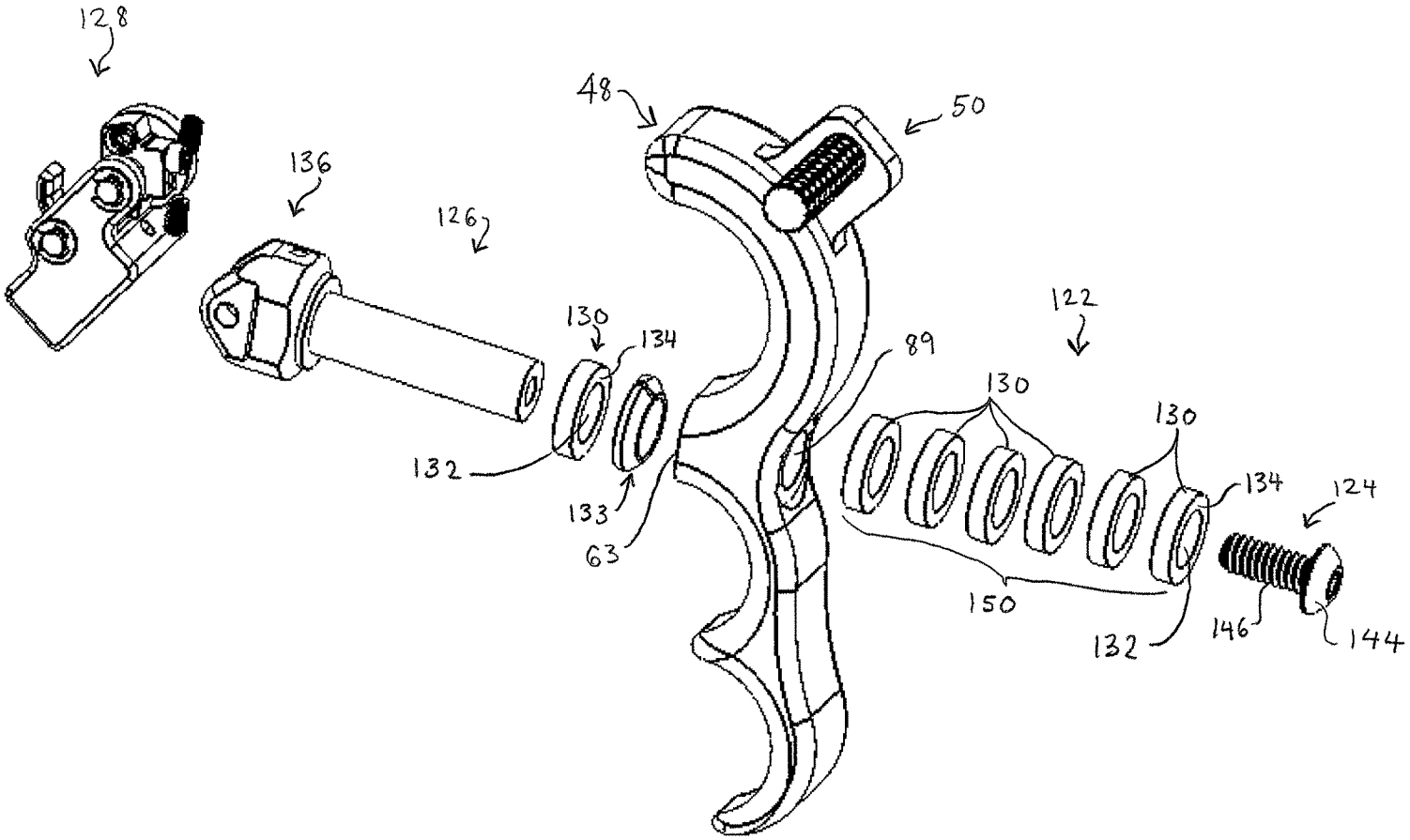
FIG. 10 is a partially-exploded, isometric view of the archery release device of FIG. 7, illustrating the head assembly separated from the head coupler.
Figure 11:
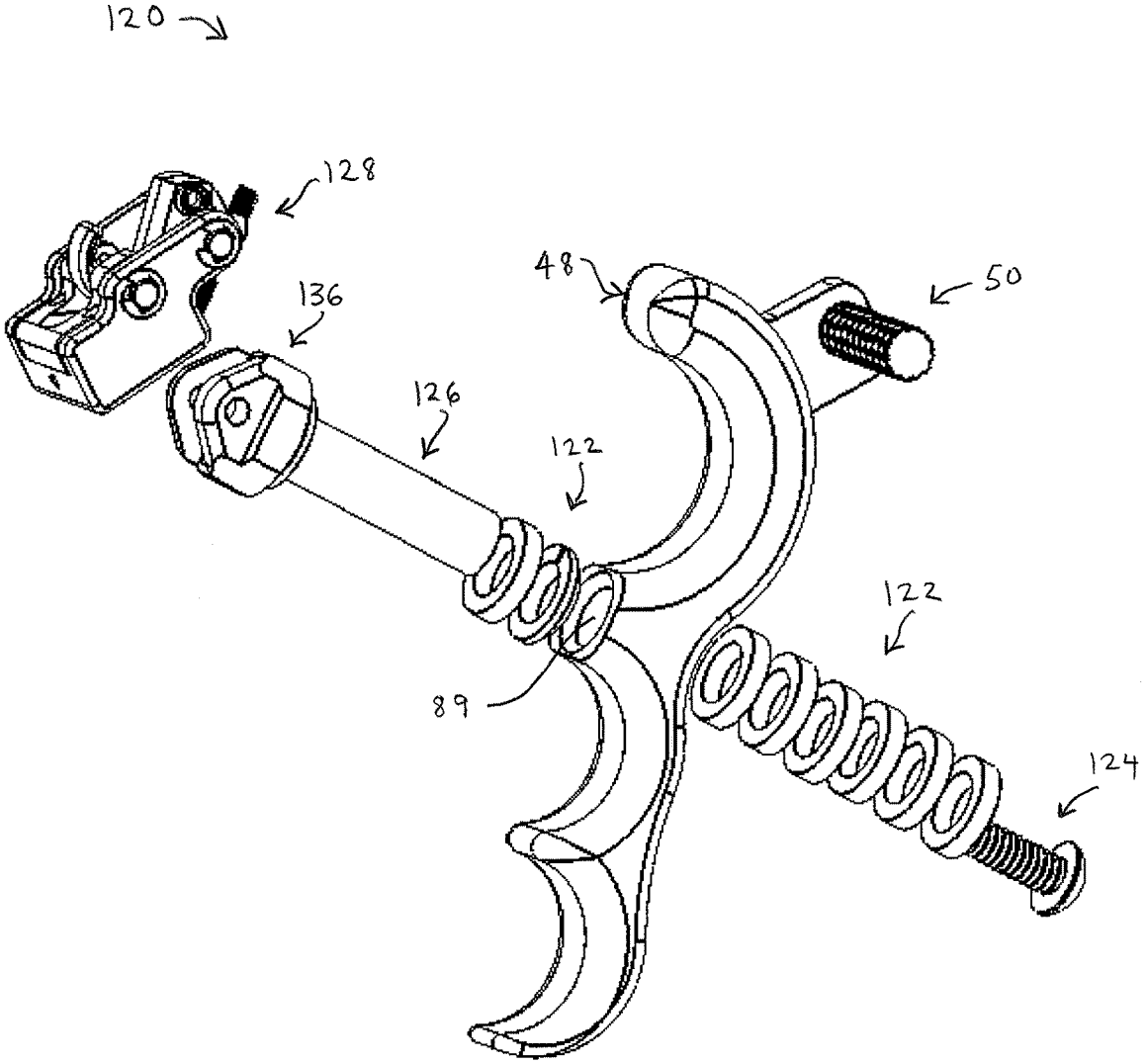
FIG. 11 is a partially-exploded, front isometric view of the archery release device of FIG. 7.
Figure 12:
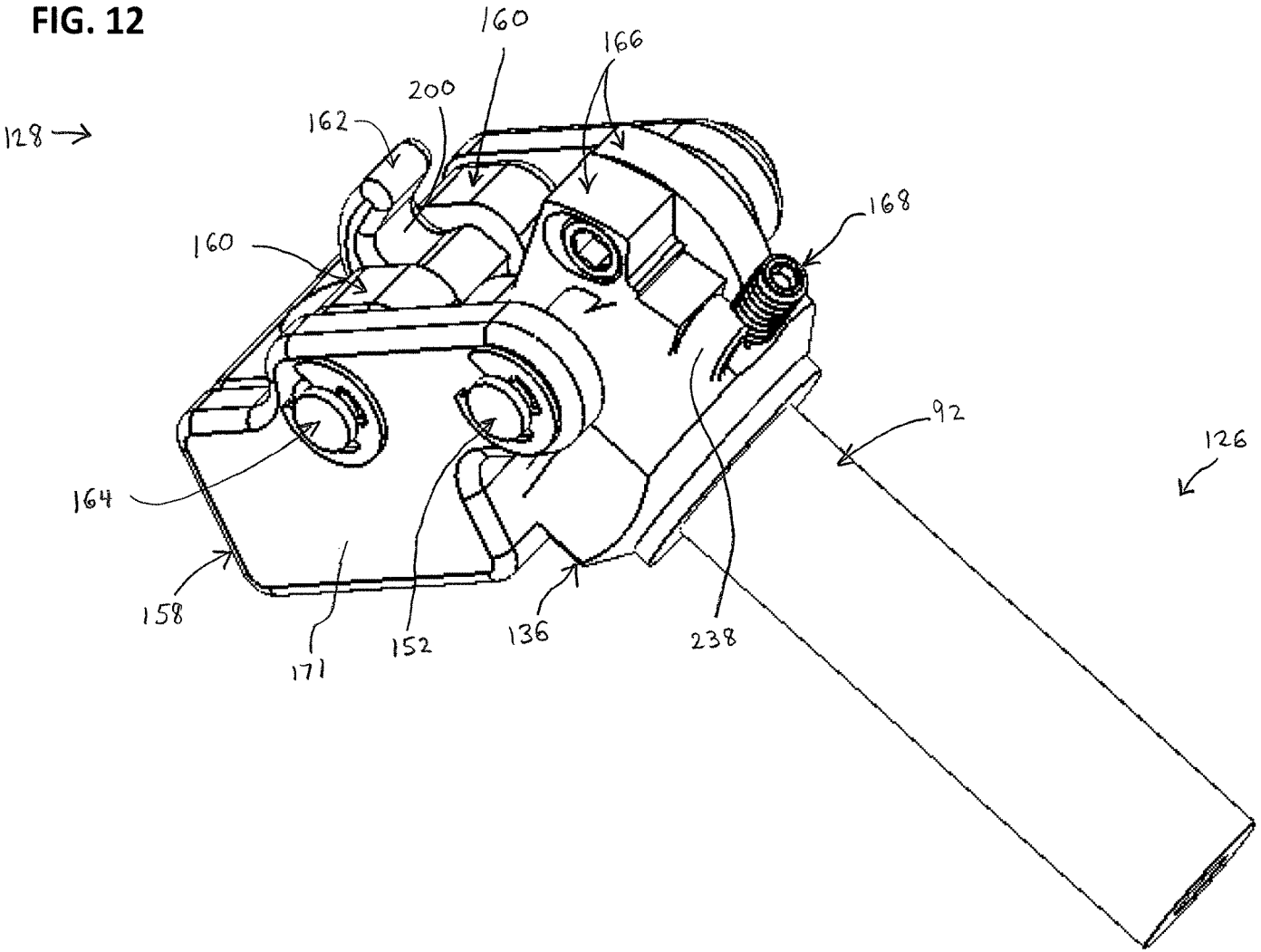
FIG. 12 is an enlarged, top isometric view of the head assembly, head coupler and neck tube of the archery release device of FIG. 7.

The thumb support 50 is attached to the upper region 82. In an embodiment, the thumb support 50 includes: (a) a mount 86 connected to, and extending from, the body 48; (b) a knob or stud 88 (e.g., a tube, pipe or rod) connected to the mount 86; and (c) a fastener 90 (FIG. 9), such as a screw or bolt, which couples the stud 88 to the mount 86. In the illustrated embodiment, the stud 88 has a frictional surface, such as knurled surface pattern, to reduce unintentional slippage between the user's thumb and the stud 88.

The neck 44, in an embodiment, includes a forward neck end 92, a rearward neck end 94 and an intermediate neck portion 96 between the neck ends 92, 94. The neck 44 is sized and shaped to movably or slidably fit within, and extend entirely through, the body opening 89. Depending upon the embodiment, the forward neck end 92 is fixedly, non-movably, movably, swivelly, rotatably or pivotally coupled to the head 52. Also, depending upon the embodiment, the neck 44 can include a rod, bolt, shaft, pipe, tube, worm gear or other suitable elongated member. In the illustrated embodiment, the head 52 includes a base 53 and a bowstring engager 55 (e.g., a bowstring hook) which is pivotally coupled to the base 53.

In an embodiment not illustrated, the neck 44 is a telescopic neck including a plurality of tubular sections configured to fit within one another. Such telescopic neck is movable from a retracted position in which multiple tubular sections fit within a larger tubular section, to an extended position in which the multiple tubular sections are spread apart but connected to each other. In this embodiment, the body opening 89 does not necessarily pass entirely through the body 48. Instead, the body opening 89 can define a recess to hold the end of such telescopic neck. In another embodiment, the body 48 lacks the body opening 89 altogether. In such case, such telescopic neck is fastened or mounted to the exterior surface of the finger separator 62 of the body 48 through one or more fasteners, welding, soldering or another suitable attachment method.

Figure 2:
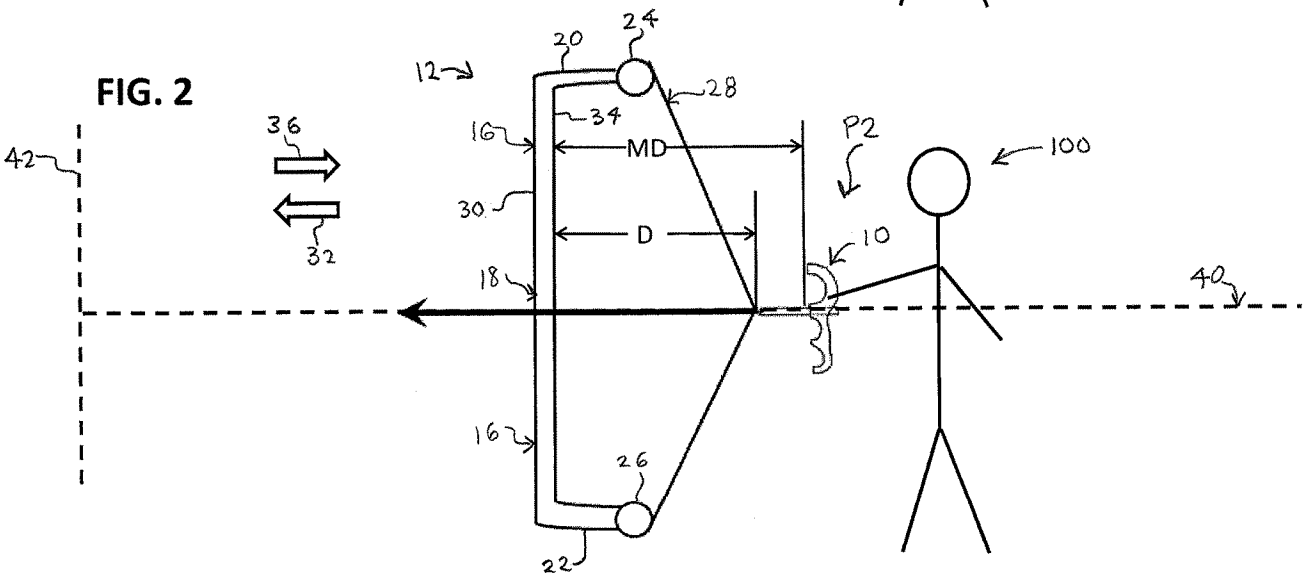
FIG. 2 is a schematic diagram of the archery release device of FIG. 1 used with the archery bow of FIG. 1 having a modified draw length suitable for a second user.

The position regulator 46 is configured to be coupled to the neck 44. Depending upon the embodiment, the position regulator 46 can be coupled both to the neck 44 and the body 48. In the example illustrated in FIGS. 1 and 3, a long arm user 99 has determined that a draw length D is suitable based on his/her arm span, and the long arm user 99 has selected archery bow 12. Archery bow 12 has a draw length D, which is appropriate for the long arm user 99. The long arm user slides, axially moves or translates the neck 44 within the body opening 89 so that the forward neck end 92 moves to an initial axial position P1 (FIG. 3) relative to an adjustment axis 102. The adjustment axis 102 intersects with the target plane 42 (FIGS. 1-2). Depending upon the location of the projectile 38, the adjustment axis 102 can be the same as or different from the shooting axis 40 (FIGS. 1-2). After reaching position P1, the long arm user 99 manipulates the position regulator 46 to secure the neck 44 in a fixed or secured position relative to the adjustment axis 102. Depending upon the embodiment, the manipulation of the position regulator 46 can involve adjustment, rotation, twisting, translation, sliding or other operational movements. In an embodiment, the position regulator 46 is configured to assert a securing force to the neck 44, and such securing force acts along the adjustment axis 102, putting the neck 44 or head 52 under tension or compression. This securing force stabilizes the neck 44 to inhibit axial movement of the neck 44 during the shooting process.

In another example illustrated in FIGS. 2 and 4, a short arm user 100 may also wish to use the same archery bow 12. However, the short arm user 100 has determined that a draw length greater than D is suitable based on his/her shorter arm span. Therefore, the short arm user 100 manipulates the position regulator 46 to unlock or free the neck 44 relative to the body 48. Next, the short arm user 100 slides, axially moves or translates the neck 44 within the body opening 89 so that the forward neck end 92 moves from the initial axial position P1 (FIG. 3) relative to the adjustment axis 102 to a final axial position P2 (FIG. 4) relative to the adjustment axis 102. In this example, the final position P2 is further from the body 48 than the initial position P1. This provides the short arm user 100 with an extended reach to hook onto the bowstring 28, effectively increasing the arm span of the short arm user 100. Consequently, as illustrated in FIG. 2, the archery bow 12 combined with the archery release device 10 provides the short arm user 100 with a modified draw length MD, which is greater than the draw length D. Therefore, the short arm user 100 can use the archery bow 12 with its original draw length D without having to modify archery bow 12 or purchase a different bow with a greater draw length.

In an embodiment, the position regulator 46 includes one or more position setters 98. Each position setter 98 can include, but is not limited to, a lock nut or other type of threaded nut, a nut with a nylon insert for generating a biasing force, a bushing, a clip, a clasp, a spring, a fully or partially-threaded bolt, a fully or partially-threaded screw (e.g., a set screw), a pin, an elastic member, a biasing device, a battery-powered motor, another suitable fastener or a combination of the foregoing items. In an embodiment, the position regulator 46 includes a forward position setter 104 and a rearward position setter 106. These position setters 104, 106 sandwich a section of the intermediate neck portion 44, applying a tension or compression force to such section, directed along the adjustment axis 102.

In another embodiment, the position regulator 46 includes a position setter 108, such as a threaded set screw, which threadably screws into the side 85 of the body 48 and makes physical contact with the intermediate neck portion 44. The position setter 108 applies a radial force to the intermediate neck portion 44 acting in a direction substantially parallel to the target plane 42.

Figure 5:
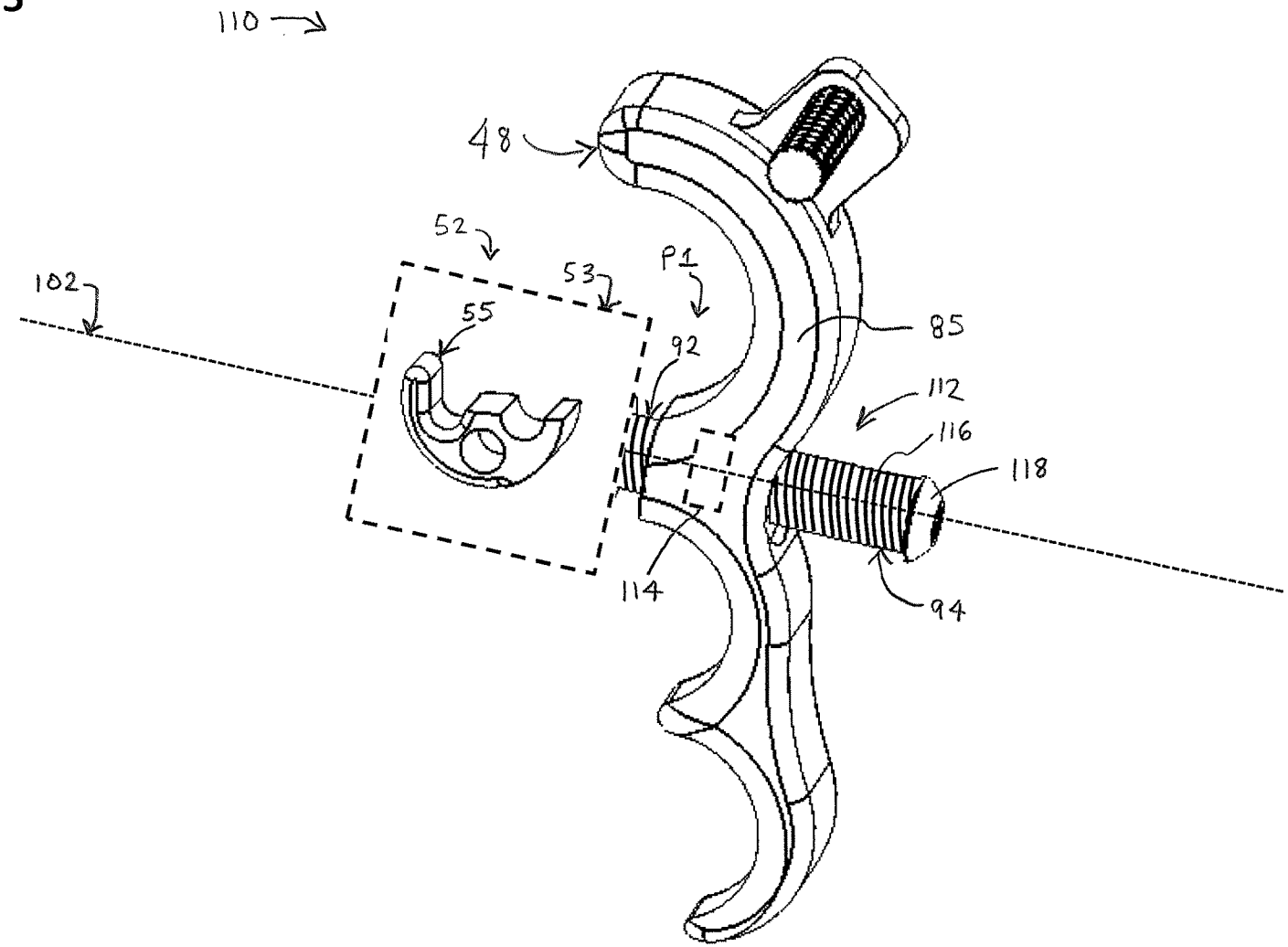
FIG. 5 is a right isometric view of another embodiment of an archery release device illustrated in a first position.
Figure 6:
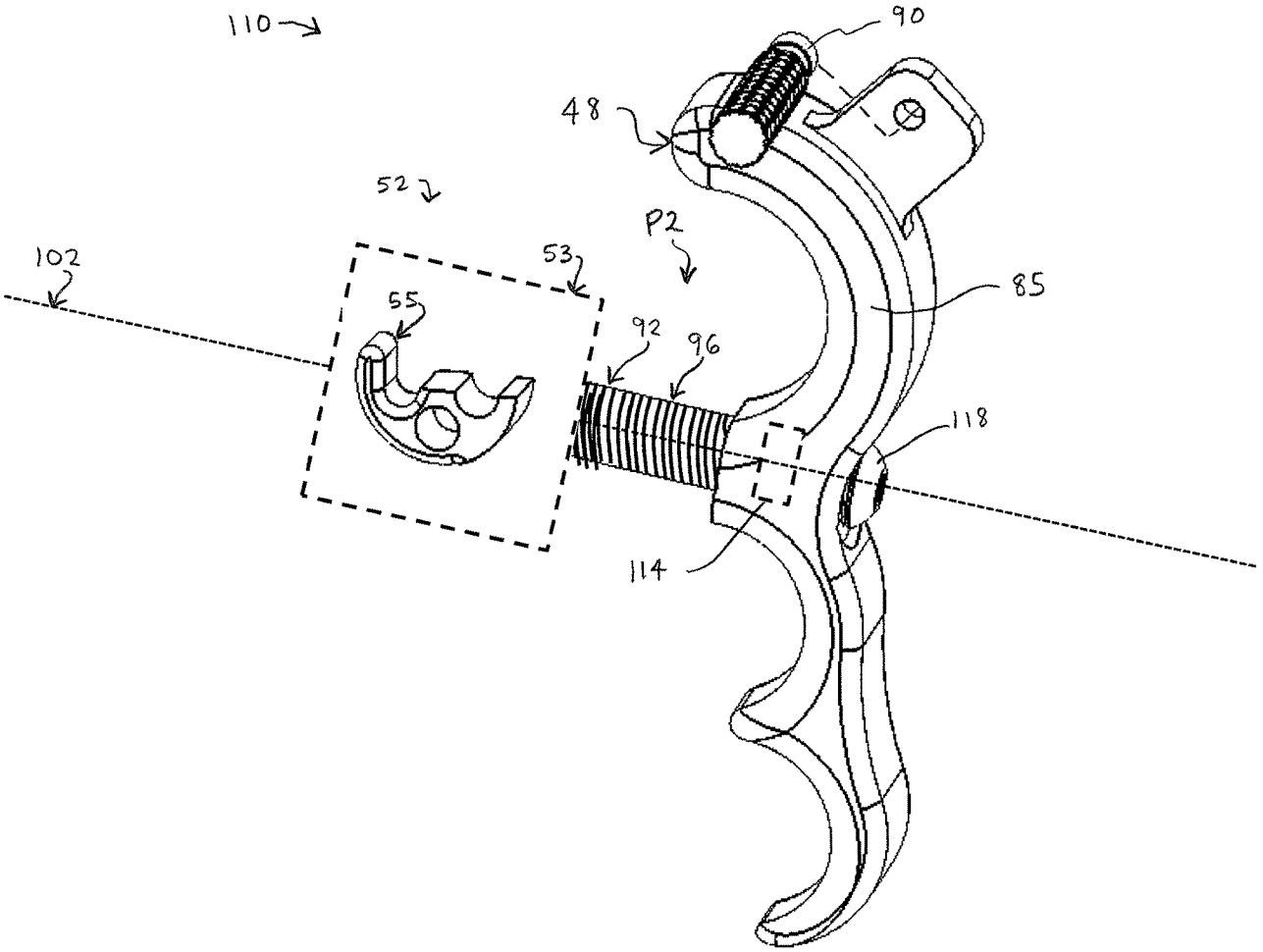
FIG. 6 is a right isometric view of the archery release device of FIG. 5 illustrated in a second position.
Figure 7:
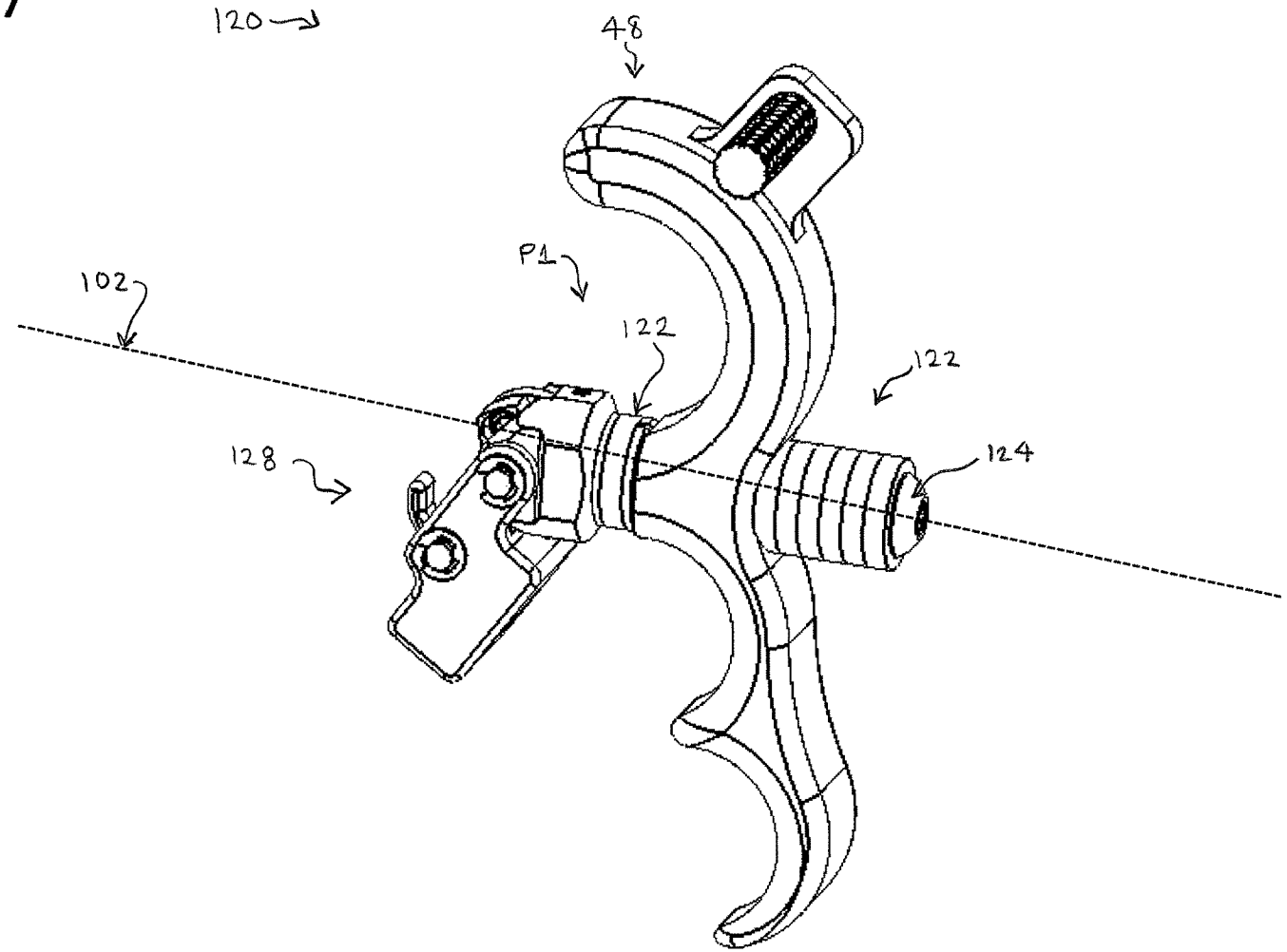
FIG. 7 is a right isometric view of yet another embodiment of an archery release device illustrated in a first position.

In an embodiment illustrated in FIGS. 5-6, the archery release device 110 has the same components, structure, elements and functionality as archery release device 10 except that: (a) the neck 44 is replaced with neck 112; and (b) the position regulator 46 includes position setter 114, which is a threaded set screw. Neck 112 has a threaded exterior surface 116, a fastener head 118, and a nylon or elastic cover or elastic coating (not shown) applied over part or all of the threaded exterior surface 116. Also, the forward neck end 92 is rotatably, swivelly or pivotally coupled to the head 52 through a suitable rotatory or bearing element. To adjust the axial position of the neck 112, the user can insert a tool (e.g., wrench or screw driver) into the fastener head 118, and rotate the neck 112 clockwise or clockwise, starting with the initial axial position P1 and ending with the final axial position P2. The elastic coating generates frictional resistance as well as: (a) an axial securing force directed along the adjustment axis 102; and (b) a radial securing force directed substantially parallel to the target plane 42. When reaching the final axial position P2, the user screws the position setter 114 through a threaded hole within the side 85 of the body 48 until reaching and applying a supplemental radial force to the neck 112. This locks or secures the neck 112 in the final axial position P2 relative to the adjustment axis 102.

In an embodiment illustrated in FIGS. 7-11, the archery release device 120 has the same components, structure, elements and functionality as archery release device 10 except that: (a) the position regulator 46 includes a position setter kit 122 and neck fastener 124; (b) the neck 44 includes a neck tube 126 and a head coupler 136; and (c) the head 52 includes a head assembly 128.

The position setter kit 122 includes a plurality of spacers 130, each of which defines a central opening 132, and the position setter kit 122 includes a securing spring member 133 (e.g., a split lock washer). The central opening 132 is sized and shaped to receive the neck tube 126. Also, in an embodiment, the central opening 132 is sized so that each side wall 134 of each spacer 130 is sized to: (a) interfere with, and abut against, the head coupler 136 and front separator surface 63 (FIG. 8) in the case of forward spacer 138; and (b) interfere with, and abut against, the back separator surface 65 (FIG. 9) in the case of rearward spacer 140. Also, the side wall 134 of rearward spacer 142 is configured to interfere with, and abut against, the fastener head 144 of neck fastener 124. In the illustrated embodiment, the spacers 130 (including spacers 138, 140 and 142) are identical in shape, size and geometry. Depending upon the embodiment, each spacer 130 can include a ring, disk, washer, block having a central hole 132, or any other suitable spacing member, whether in the shape of a circle, oval, square or other polygon. In an embodiment, all of the spacers 130 are rigid. In another embodiment, one or more of the spacers 130 are semi-rigid, resilient, elastic or compressible.

Figure 8:
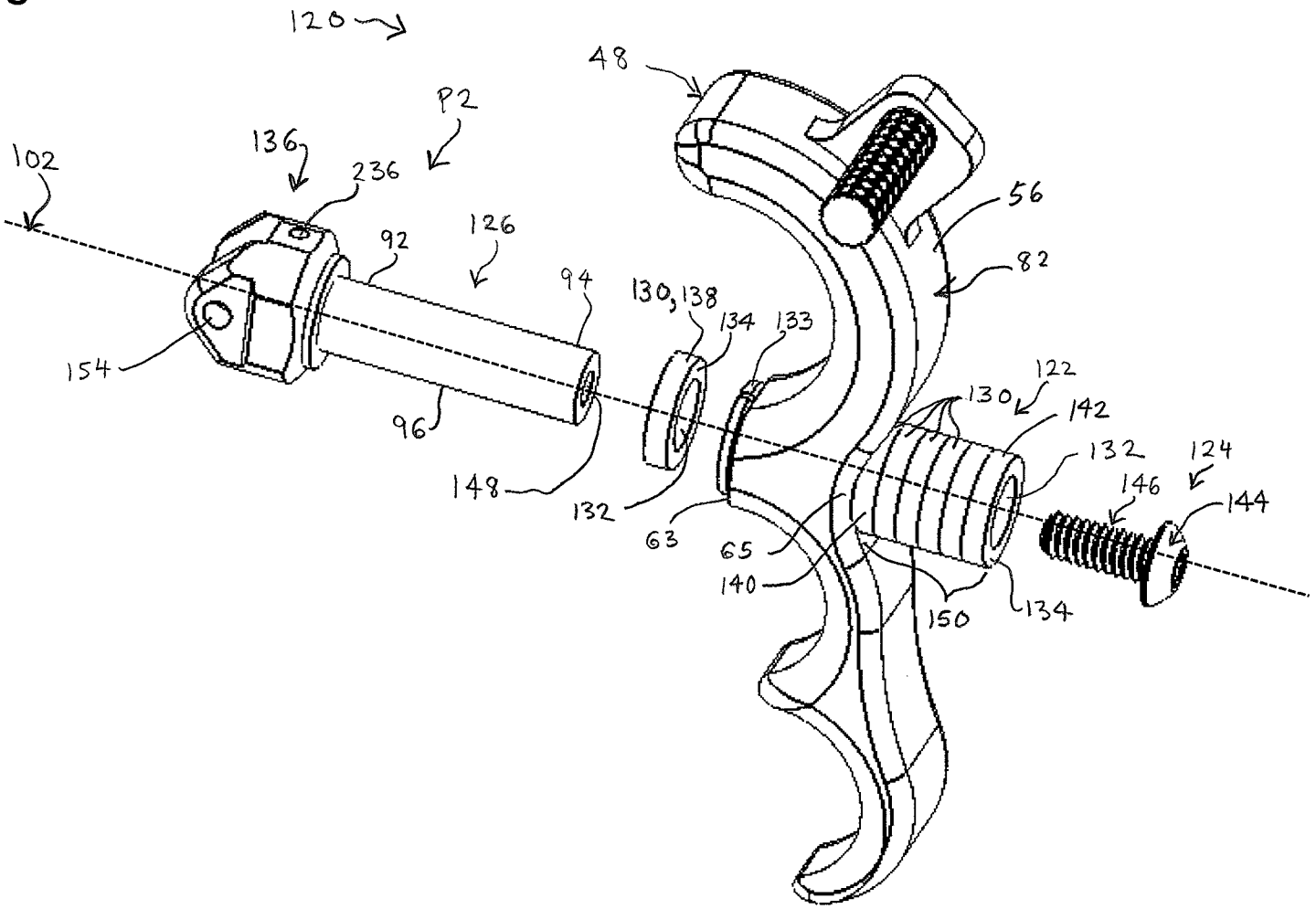
FIG. 8 is a partially-exploded, isometric view of the archery release device of FIG. 7.
Figure 13:
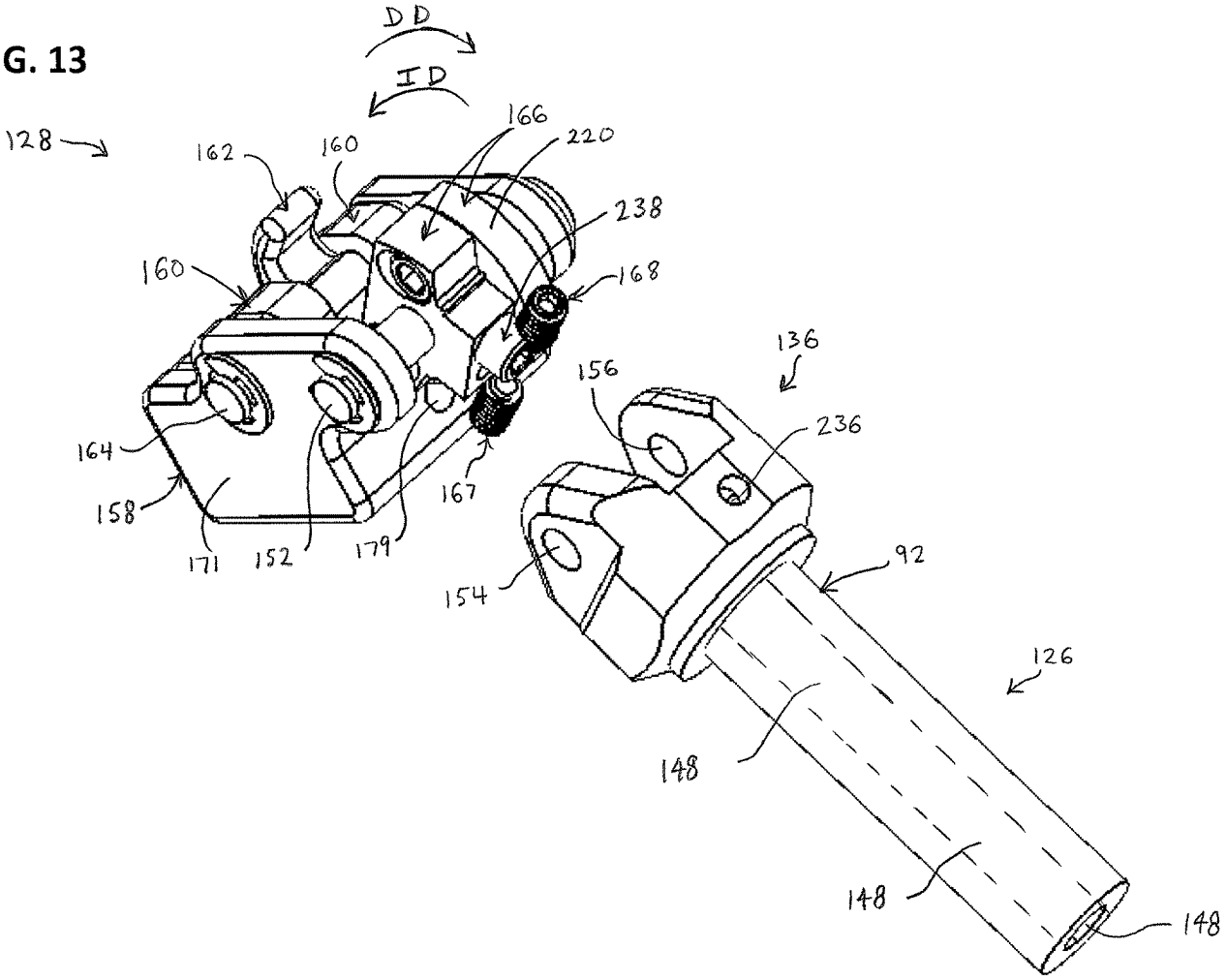
FIG. 13 is an enlarged, exploded, top isometric view of the head assembly, head coupler and neck tube of the archery release device of FIG. 7.

The neck fastener 124, in an embodiment, is a bolt or screw having a fastener extension 146 connected to the fastener head 144. The neck tube 126 has a threaded, inner wall defining an inner neck channel 148 (FIG. 13). The inner neck channel 148 extends along the adjustment axis 102 (FIG. 8). In an embodiment, the inner neck channel 148 is as long as, or longer than, the fastener extension 146.

To adjust the effective draw length, the user can change the distribution of spacers 130 from the back side 56 of the body 48 to the front side 54 of the body 48. For example, locating the single spacer 130 forward of the body 48 while the six spacers 130 are located rearward of the body 48, can result in position P1 for a draw length D for the long arm user 99 (FIG. 1). In an example not shown, locating six spacers 130 forward of the body 48 and a single spacer rearward 36 of the body 48, can result in position P2 for a modified draw length MD (FIG. 2) for the short arm user 100. It should be appreciated that the position setter kit 122 can include any suitable quantity of spacers 130, not necessarily the seven spacers 130 illustrated.

In an example, first the user decides upon the forward and rearward distribution of spacers 130 according to his/her desired draw length (e.g., draw length D or modified draw length MD). In the illustrated example, the user decided to locate spacer 138 forward of the body 48 and spacers 150 rearward of the body 48. Then, the user slides spacer 138 and securing spring member 133 onto and over the neck tube 96. Next, the user inserts the rearward neck end 94 through the body opening 89. After the rearward neck end 94 emerges through the back side 56, the user slides the spacers 150 onto and over the neck tube 96. Next, the user screws the neck fastener 124 into the neck tube 96. During the screwing process, the neck fastener 124 draws the neck tube 96 closer to the body 48 which, in turn, eventually forces the head coupler 136 against the forward spacer 138. When the neck fastener 124 is in a tightened condition: (a) the head coupler 136 is compressed against the forward spacer 138; (b) the forward spacer 138 is compressed against the securing spring member 133; (c) the securing spring member 133 is compressed against the front separator surface 63, and the securing spring member 133 generates a spring force acting along the adjustment axis 102; (d) spacer 140 is compressed against the back separator surface 65; (e) the spacers 150 are compressed against each other; (f) the fastener head 144 is compressed against the spacer 142; and (g) the fastener extension 146 and neck tube 126 are each subject to tensile forces acting in opposite directions 32, 36 along the adjustment axis 102.

Because of this arrangement, the header coupler 136, neck tube 126, securing spring member 133 and spacers 130 are all subject to axial securing forces (compressive or tensile) acting along the adjustment axis 102. These axial securing forces prevent or impede any undesired sliding or movement of the neck tube 126 relative to the body 48. Accordingly, in an embodiment, as the user transitions from holding the retracted bowstring 28 using the archery release device 120 to releasing the bowstring 28 using the archery release device 120, the neck tube 126 remains stationary relative to the body 48. This minimizes or reduces internal looseness within the archery release device 120, resulting in a smoother operation and enhanced release responsiveness and control.

If the user desires to change to a different draw length, such as modified draw length MD (FIG. 2), the user can, for example, relocate four of the spacers 130 from the back side 56 of the body 48 to the front side 54 of the body 48. In such example, there would be five spacers 130 between the head coupler 136 and the front separator surface 63, and there would be two spacers 130 between the fastener head 144 and back separator surface 65. Performing this step would cause the forward neck end 92 to move or translate from initial position P1 (FIGS. 1, 3 and 7) to the final position P2 (FIGS. 2 and 4).

Referring to FIGS. 12-22, in an embodiment, the forward neck end 92 is fixedly or otherwise non-movably connected to the head coupler 136. For example, the forward neck end 92 can be tightly screwed into or soldered or welded onto the head coupler 136. The head coupler 136 is pivotally coupled to the head assembly 128 through the use of pivot member 152 (e.g., a pin or bolt). As illustrated in FIG. 13, the head coupler 136 defines a plurality of spaced-apart openings 154, 156 configured to receive the pivot member 152.

The head assembly 128 includes: (a) a base 158; (b) a slidable support or sled 160 supported by the base 158; (c) a bowstring engager or bowstring hook 162 pivotally coupled to the sled 160 through the use of pivot member 164 (e.g., a pin or bolt); (d) a movement restrictor or hook restrictor 166 (e.g., a sear) pivotally coupled to the sled 160 through the use of pivot member 152; and (e) release sensitivity adjusters 167, 168 (e.g., set screws) operable to adjustably set or fix the rotational position of the hook restrictor 166 relative to the bowstring hook 162.

Figure 14:
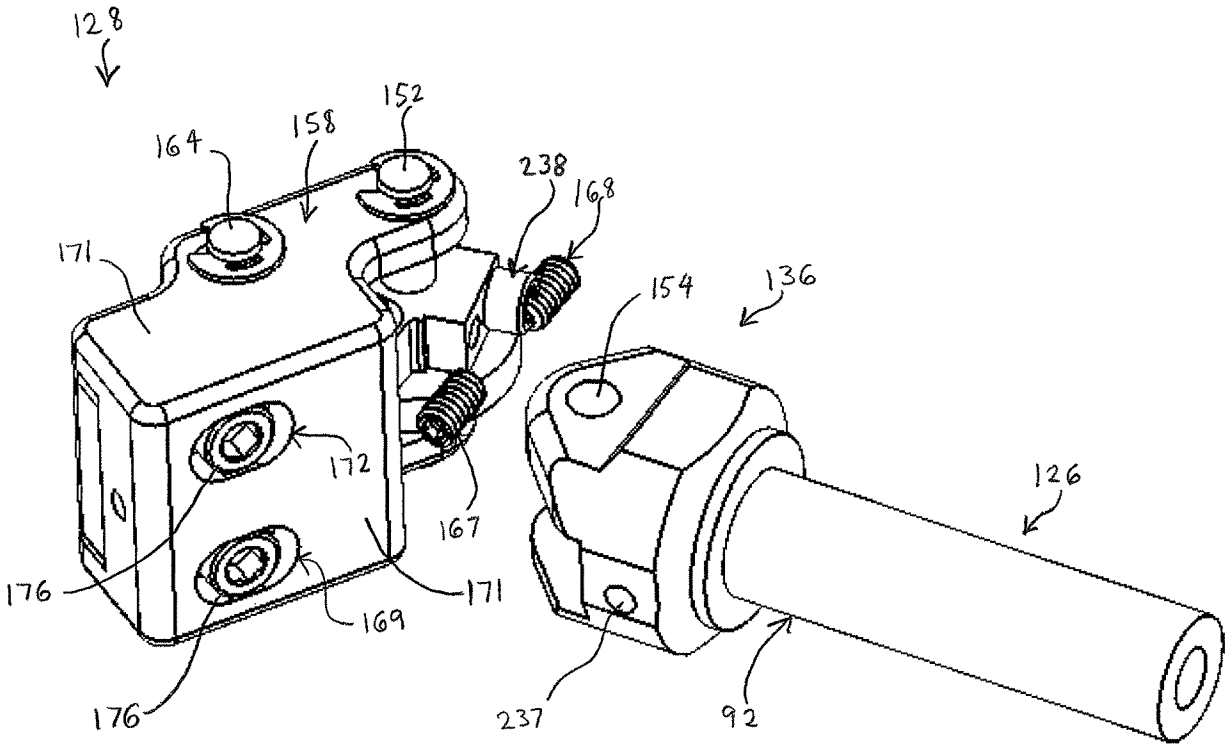
FIG. 14 is an enlarged, exploded, bottom isometric view of the head assembly, head coupler and neck tube of the archery release device of FIG. 7.
Figure 15:
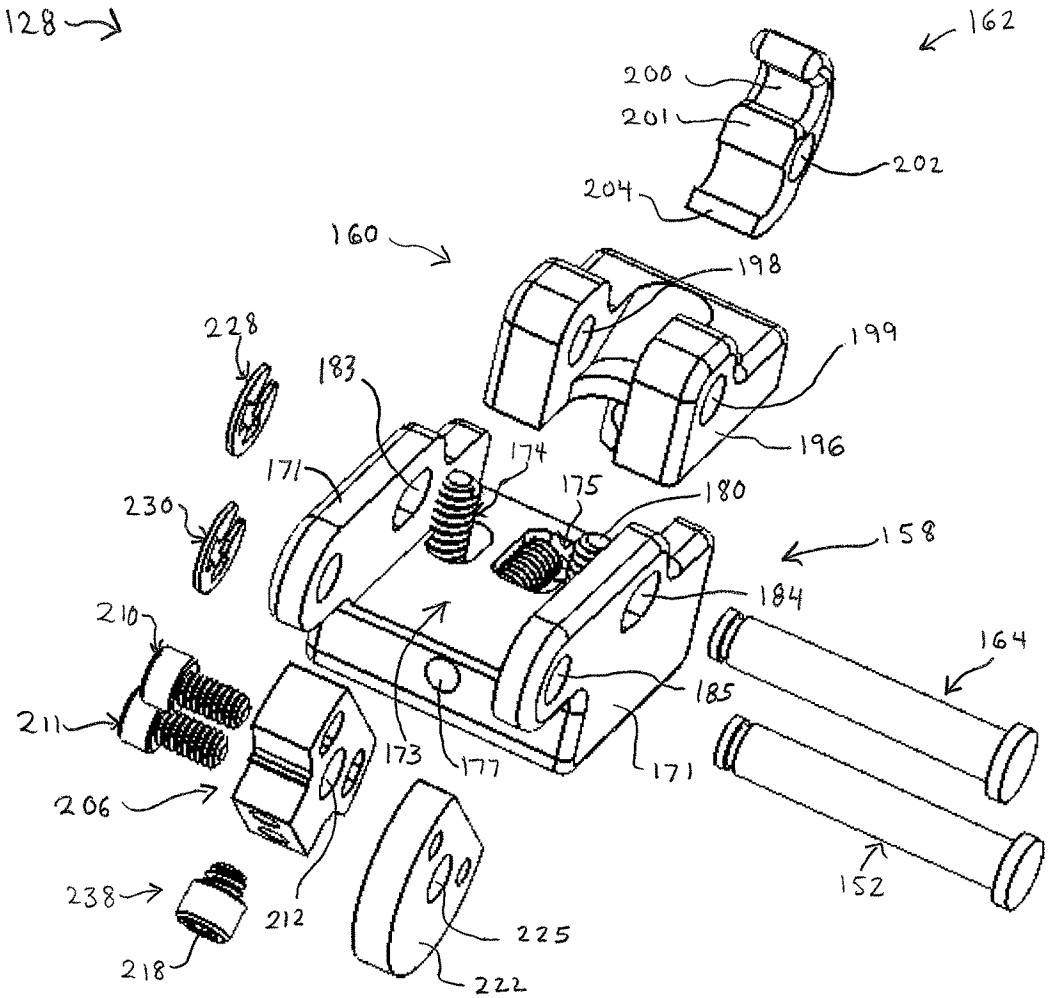
FIG. 15 is an enlarged, exploded, top isometric view of the head assembly of the archery release device of FIG. 7.
Figure 16:
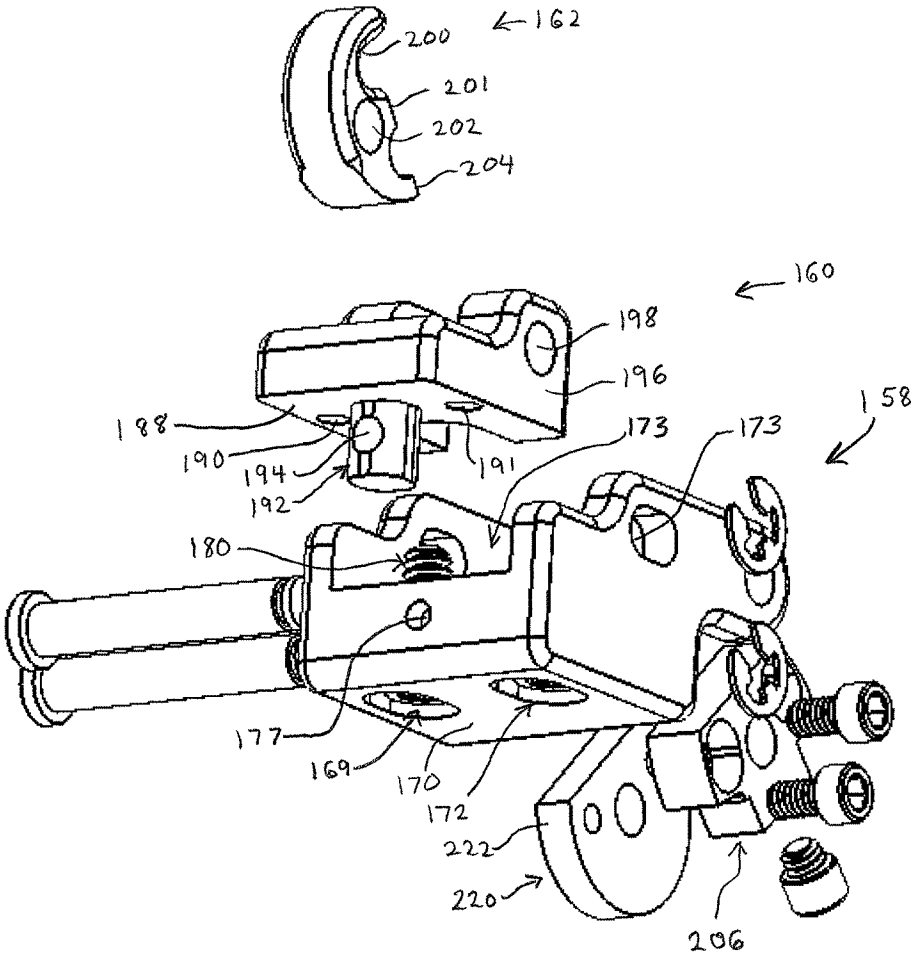
FIG. 16 is an enlarged, exploded, rear isometric view of the head assembly of the archery release device of FIG. 7.

As illustrated in FIGS. 13-16, the base 158 includes: (a) a base bottom 170 which defines: (i) a plurality of elongated slots 169, 172 (e.g., oval or rectangular openings), as illustrated in FIGS. 14 and 16; (ii) an elongated cavity 175 (e.g., an oval or rectangular inner space or pocket), as illustrated in FIG. 15; (iii) a forward access opening 177, as illustrated in FIG. 15; and (iv) a rearward access opening 179, as illustrated in FIG. 13; (b) a plurality of side walls 171 extending upward from the base bottom 170; and (c) a main cavity 173 (e.g., an inner space or pocket) defined by the base bottom 170 and side walls 171, as illustrated in FIG. 16.

As illustrated in FIG. 15, the side walls 171 of the base 158 define a set of pilot openings 181, 185 configured to receive the pivot member 152, and the side walls 171 also define a set of elongated slots 183, 184 (e.g., oval or rectangular openings) configured to receive the pivot member 164.

Figure 17:
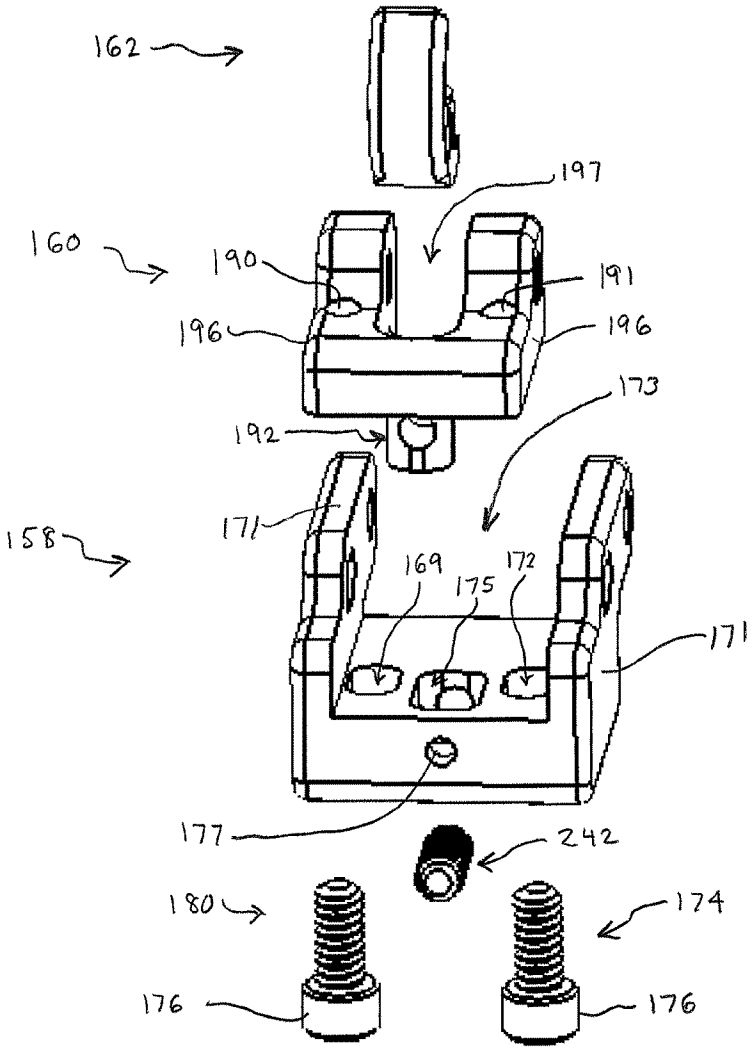
FIG. 17 is another enlarged, exploded, rear isometric view of the head assembly of the archery release device of FIG. 7.

As illustrated in FIG. 17, a plurality of base fasteners 174, 180 (e.g., threaded screws or bolts) are configured to be inserted through the elongated slots 172, 169, respectively. Each base fastener 174, 180 has a head 176 with a diameter less than the major diameter of the elongated slots 172, 169.

The sled 160 has a sled bottom 188 (FIG. 16) which defines a plurality of threaded openings 190, 191 configured to threadably engage with the base fasteners 174, 180, respectively. The sled 160 also has a follower 192 (e.g., an arm) extending downward from the sled bottom 188. The follower 192 defines a threaded opening 194. In addition, the sled 160 has a plurality of side walls 196 which define: (a) a sled cavity 197 (FIG. 17); and (b) a plurality of pilot openings 198, 199 (e.g., non-threaded openings) configured to receive the pivot member 152, as illustrated in FIG. 15.

As illustrated in FIG. 17, to couple the sled 160 to the base 158, an assembler can place the sled 160 into the main cavity 173 while guiding the follower 192 into the elongated cavity 175, insert the base fasteners 180, 174 through the elongated slots 169, 172, and screw the base fasteners 180, 174 into the threaded openings 190, 191, respectively, of the sled 160.

As illustrated in FIG. 15, in an embodiment, the bowstring hook 162 includes: (a) a bowstring engagement portion 200 (e.g., a curved or U-shaped surface); (b) a central hook portion 201 defining an opening 202 configured to receive the pivot member 164 for pivotally connecting the bowstring hook 162 to the sled 160; and (c) a catch portion 204 configured to slidably interface with the movement restrictor or hook restrictor 166, as described below.

Figure 18:
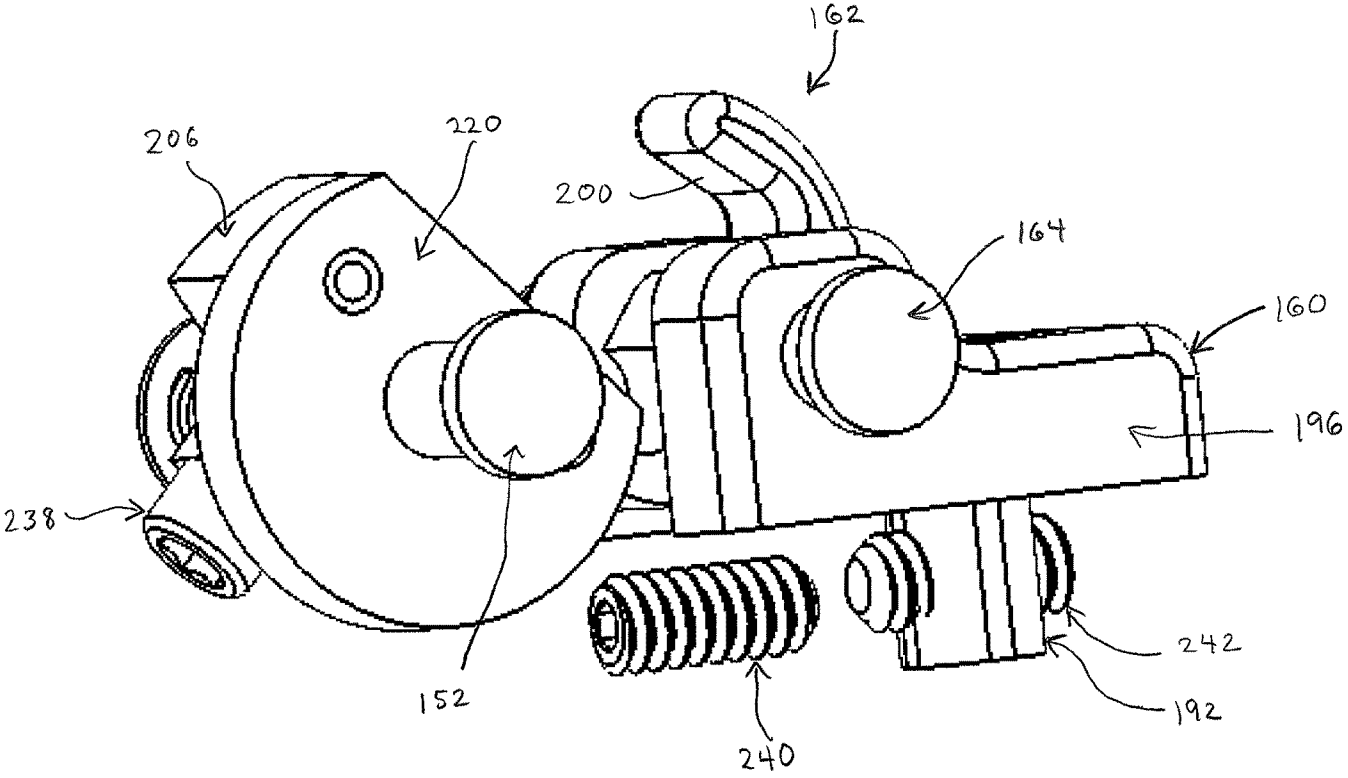
FIG. 18 is an enlarged, left isometric view of the hook restrictor, bowstring hook and sled of the head assembly of the archery release device of FIG. 7.
Figure 19:
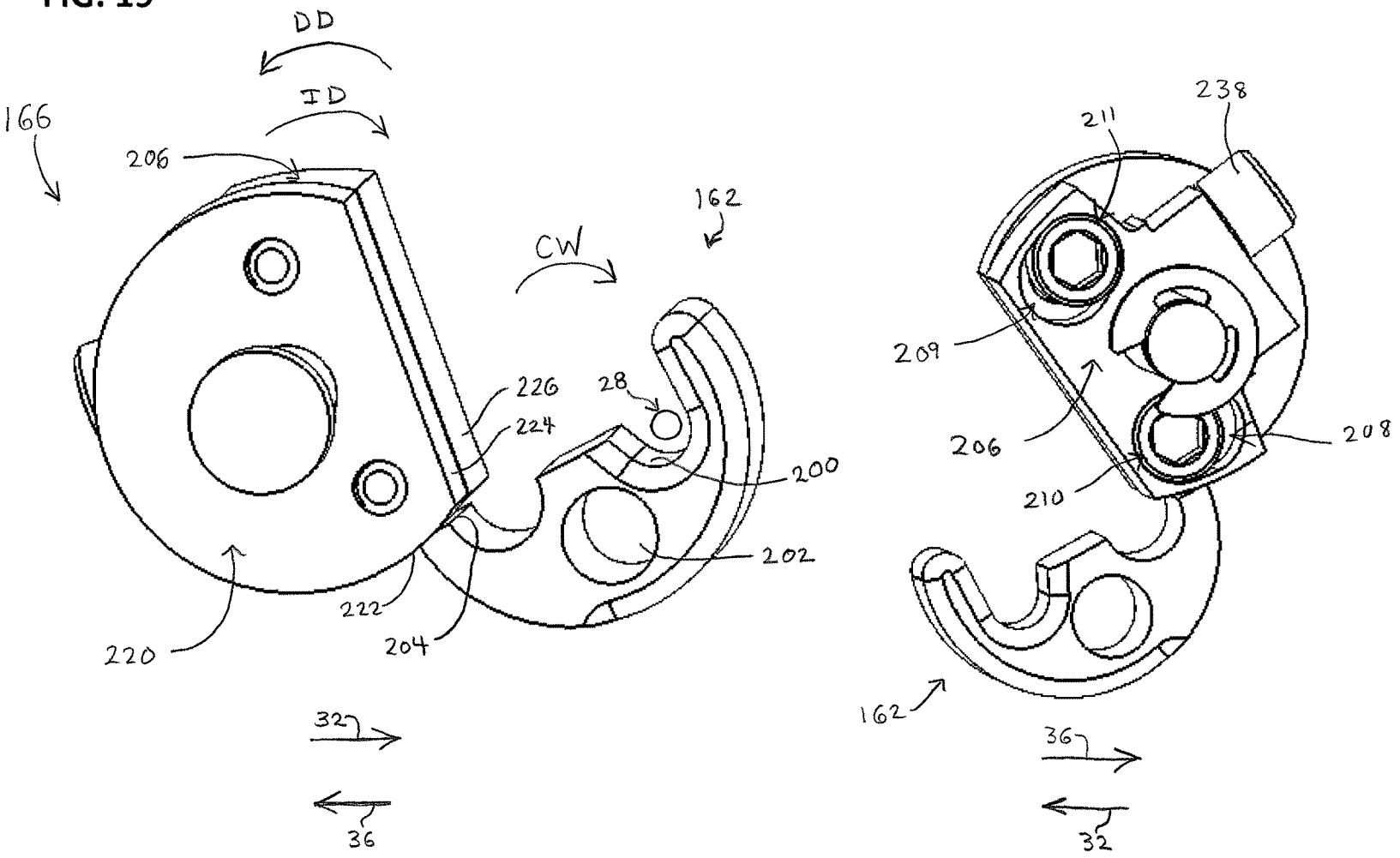
FIG. 19 is an illustration of enlarged, left and right isometric views of the hook restrictor and bowstring hook of the head assembly of the archery release device of FIG. 7.
Figure 20:
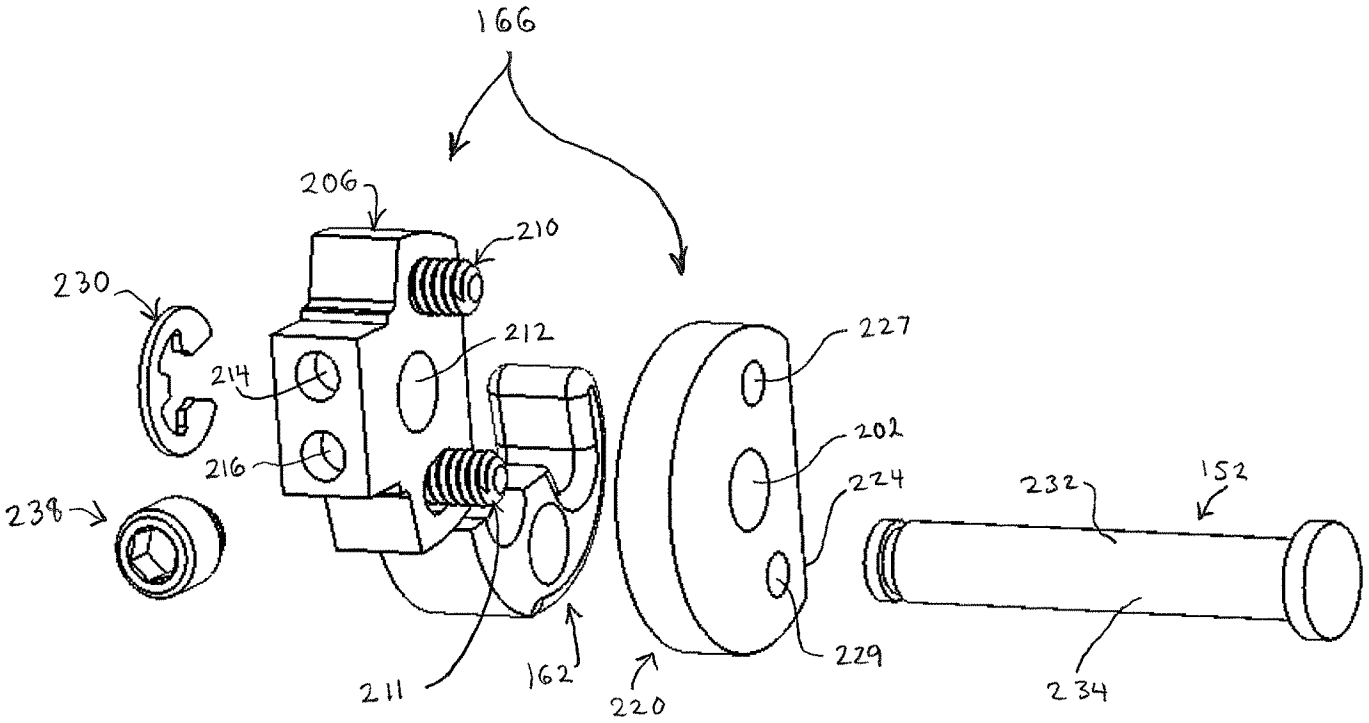
FIG. 20 is an enlarged, exploded, rear isometric view of the hook restrictor and bowstring hook of the head assembly of the archery release device of FIG. 7.
Figure 21:
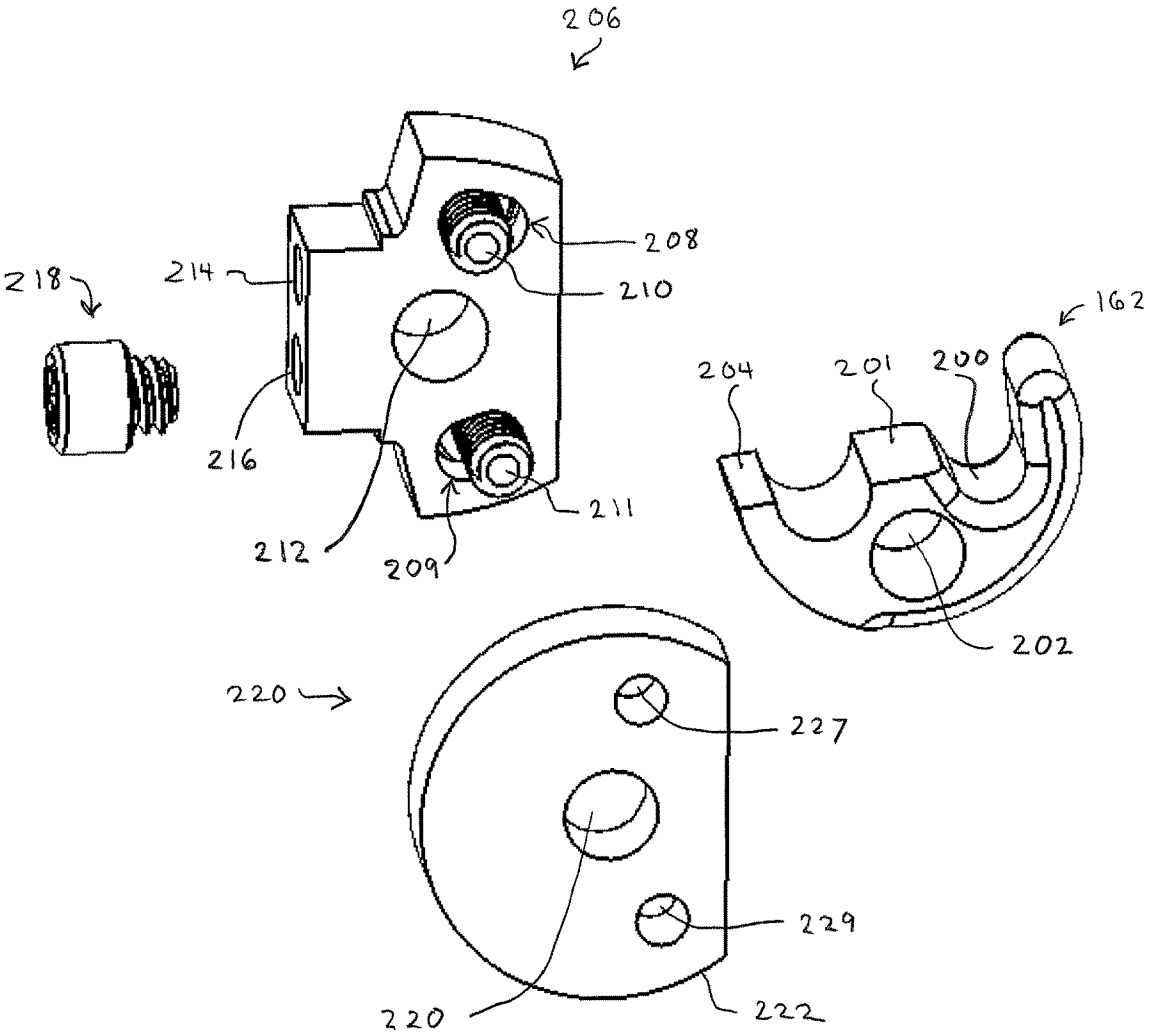
FIG. 21 is an enlarged, exploded, left isometric view of the hook restrictor and bowstring hook of the head assembly of the archery release device of FIG. 7.
Figure 22:
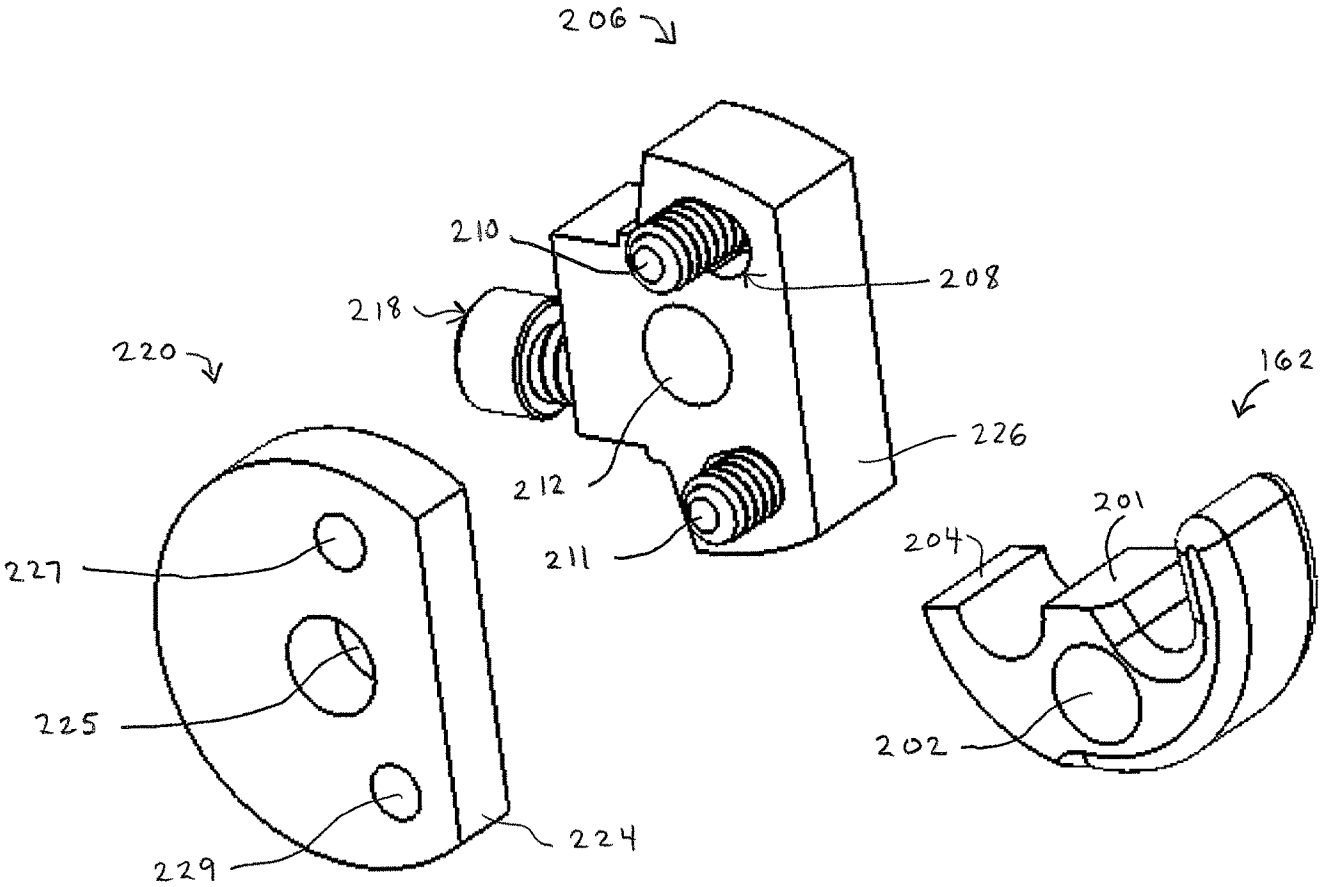
FIG. 22 is another enlarged, exploded, left isometric view of the hook restrictor and bowstring hook of the head assembly of the archery release device of FIG. 7.

Referring to FIGS. 13, 15 and 18-22, in an embodiment, the hook restrictor 166 includes: (a) a restrictor base 206 defining: (i) a plurality of elongated mount slots 208, 209 (e.g., oval or rectangular openings) configured to receive mount fasteners 210, 211, as illustrated in FIG. 21; (ii) a central opening 212 configured to receive the pivot pin 152, as illustrated in FIG. 21; and (iii) a plurality of threaded position setting openings 214, 216, each of which is configured to receive the release sensitivity fastener 218 (e.g., set screw), as illustrated in FIGS. 20-21; and (b) a hook engager 220 (e.g., a holder, moon or moon-shaped member) having: (i) an arc-shaped or cylindrical hook engagement surface 222 (FIG. 19) configured to be engaged with the catch portion 204 when the archery release device 120 is in the pre-release condition; and (ii) a clearance surface 224 (FIG. 19) configured to avoid interference with, and enable movement of, the catch portion 204 when the archery release device 120 is in the post-release condition.

In an embodiment, the archery release device 120 is in the pre-release condition when the user is pulling back on the retracted bowstring 28 while aiming. The archery release device 120 transitions from the pre-release condition to the post-release condition when the user flexes or tenses his/her back muscles. Referring to FIG. 19, this back muscle action causes the user's holding hand to move rearward and laterally, slightly rotating relative to the user's shoulder. This motion causes the archery release device 120 to move rearward and laterally along an arc path, generating a rearward and lateral force on the bowstring hook 162, causing the bowstring 28 to generate a counteractive forward force. When the counteractive forward force reaches a threshold level, it overcomes the frictional force between the cylindrical hook engagement surface 222 of the hook restrictor 166 and the catch portion 204 of the bowstring hook 162. This causes the bowstring hook 162 to disengage from, and pivot clockwise CW beyond, the hook engager 220 of the hook restrictor 166. As the bowstring hook 162 pivots clockwise CW, the bowstring 28 slides out of the bowstring engagement portion 200 which, in turn, causes the projectile 38 (FIGS. 1-2) to fly through the air toward the target plane 42 (FIGS. 1-2).

As illustrated in FIG. 20, the hook engager 220 defines a central opening 202 and a plurality of threaded openings 227, 229. In an embodiment, when the hook engager 220 is screwed onto the restrictor base 206 using mount fasteners 210, 211, the clearance surface 226 (FIG. 19) of restrictor base 206 is also configured to avoid interference with, and enable movement of, the catch portion 204 when the archery release device 120 enters the post-release condition.

In an embodiment, the method of assembling the head coupler 136, assembling the head assembly 128 and adjusting the archery release device 120 for variable draw lengths and release sensitivities, includes the following steps:

A. Insert the sled 160 into the main cavity 173 of the base 158 while inserting the follower 192 into the elongated slot 175, as illustrated in FIG. 17.

B. Insert the base fasteners 180, 174 through the elongated slots 169, 172, respectively, and screw the base fasteners 180, 174 into the threaded openings 190, 191, respectively, as illustrated in FIG. 17. The elongation of elongated slots 169, 172 enables a first head adjustment mode, as described further below.

C. Insert the bowstring hook 162 into the sled cavity 197, and slide the pivot member 164 through the pilot openings 184, 199, then through the opening 202 of the bowstring hook 162, and then through the pilot openings 198, 183, as illustrated in FIG. 15.

D. Attach the fastener 228 (e.g., C-clip) to the pivot member 164 to secure the pivot member 164 to the base 158, as illustrated in FIG. 15.

E. Attach the hook engager 220 to the restrictor base 206 using the mount fasteners 210, 211, as described above.

F. Insert the pivot member 152 through the pilot opening 185, central opening 225 of the hook engager 220, central opening 212 of the restrictor base 206, and through the pilot opening 181, as illustrated in FIG. 15.

G. Attach the fastener 230 (e.g., C-clip) to the pivot member 152 to secure the pivot member 152 to the base 158, as illustrated in FIG. 15.

H. Select, using the user's preference and discretion, whether to screw the release sensitivity fastener 218 into the upper position setting opening 214 or lower position setting opening 216, as illustrated in FIG. 20. In an embodiment, this selection step involves a second head adjustment. For example, if the user screws the release sensitivity fastener 218 into the upper position setting opening 214, the end of the fastener 218 will strike, and make contact with, the upper portion 232 (FIG. 21) of the pivot member 152, causing the hook restrictor 166 to move upward, further away from the base 158. This is because, in this embodiment, the central openings 212, 225 are substantially larger than the diameter of the pivot member 152. If, on the other hand, the user screws the release sensitivity fastener 218 into the lower position setting opening 216, the end of the fastener 218 will strike, and make contact with, the lower portion 234 (FIG. 21) of the pivot member 152, causing the hook restrictor 166 to move downward, closer to the base 158. Therefore, based on this second head adjustment mode, the user can slightly adjust the upward and downward positions of the hook engagement surface 222 relative to the catch portion 204.

I. After the second head adjustment mode, the user screws the release sensitivity adjusters 167, 168 into the head coupler 136, as illustrated in FIGS. 13-14. Head coupler 136 defines threaded hole 236 (FIG. 13) and threaded hole 237 (FIG. 14) located opposite of threaded hole 236. When screwed into threaded holes 236, 237, the release sensitivity adjusters 167, 168, respectively, strike and drive the fastener head 238 of the release sensitivity fastener 218. By screwing the sensitivity adjusters 167, 168 inward or outward, the user can cause the movement restrictor or hook restrictor 166 to rotate relative to the base 158, resulting in a third head adjustment mode. Consequently, this third head adjustment mode enables the user to rotate (and change the angular position) of the hook engagement surface 222 (FIG. 19) relative to the catch portion 204 of the bowstring hook 162. For example, the user can unscrew the release sensitivity adjuster 167 and screw-in the release sensitivity adjuster 168. As illustrated in FIGS. 13 and 19, this will cause the hook restrictor 166 to rotate in a sensitivity decrease direction DD relative to the catch portion 204 of the bowstring hook 162. The sensitivity decrease direction DD movement will place more of the hook engagement surface 222 in interference with the catch portion 204 of the bowstring hook 162. As a result, an increase amount of back tension force or jerking will be required to cause the catch portion 204 to slide past the hook engagement surface 222. Therefore, the user's back must exert an increased amount of force to enable the bowstring hook 162 to rotate to release the bowstring 28. This may be preferred if the user desires to decrease the release sensitivity of the archery release device 120. In another example, the user can screw-in the release sensitivity adjuster 167 and unscrew the release sensitivity adjuster 168. As illustrated in FIGS. 13 and 19, this will cause the hook restrictor 166 to rotate in a sensitivity increase direction ID relative to the catch portion 204 of the bowstring hook 162. The sensitivity increase direction ID movement will place less of the hook engagement surface 222 in interference with the catch portion 204 of the bowstring hook 162. As a result, a decrease amount of back tension force or jerking can be used to cause the catch portion 204 to slide past the hook engagement surface 222. Therefore, the user's back can exert this decreased amount of force to enable the bowstring hook 162 to rotate to release the bowstring 28. This may be preferred if the user desires to increase the release sensitivity of the archery release device 120.

J. For the first head adjustment mode, as illustrated in FIGS. 16 and 18, the user can slightly, rotationally, gradually or incrementally drive the sled 160 to slide and translate forward 32 or rearward 36 (FIGS. 1-2) relative to adjustment axis 102. In this first head adjustment mode, the user can partially loosen base fasteners 180, 174 to enable the sled 160 to be slidably repositioned relative to the base 158. Next, the user screws the rearward driver 240 (e.g., threaded screw or worm gear) into the threaded rearward access opening 179 (FIG. 13), and the user screws the forward driver 242 into the forward access opening 177 (FIG. 15). The user continues to screw one or both of the drivers 240, 242 until the drivers 240, 242 physically contact each other. Once drivers 240, 242 strike each other, the user can continue to screw either of the drivers 240, 242. The continued screwing will cause the sled 160 to slide relative to the base 158 which, in turn, will cause the bowstring hook 162 to axially translate to increase the distance between the bowstring hook 162 and the hook restrictor 166. This movement or repositioning occurs along or parallel to the adjustment axis 102 when the base bottom 170 is pivoted to extend in a plane which is parallel to the adjustment axis 102. An increased distance between the bowstring hook 162 and hook restrictor 166 results in an increased release sensitivity. This is because the increased distance causes less of the hook engagement surface 222 to be in interference with the catch portion 204 of the bowstring hook 162. A decreased distance between the bowstring hook 162 and hook restrictor 166 results in a decreased release sensitivity. This is because the decreased distance causes more of the hook engagement surface 222 to interfere with the catch portion 204 of the bowstring hook 162. Therefore, the first head adjustment mode enables the user to adjust the sensitivity of the archery release device 120 independent of the second and third head adjustment modes. It should be appreciated that the first head adjustment mode also enables a micro-adjustment of draw length because the sled 160 is slidable along adjustment axis 102 (FIG. 3) to change the distance between the bowstring hook 162 and the hook restrictor 166 along the adjustment axis 102.

As described above, the head assembly 128 and head coupler 136 collectively enable, and are associated with, at least three head adjustment modes. This provides the user with an enhanced level of fine-tuning control over the release sensitivity and effective draw length of the archery release device 120. This provides an important improvement for release responsiveness selection in a context where relatively small positional changes between the engagement hook 162 and movement restrictor or hook restrictor 166 can have a relatively large effect on the user's overall bow shooting performance.

In the examples described above with respect to FIGS. 1-2, the archery release device 10 is operable by different users 99, 100 of a single archery bow 12. It should be appreciated that in another example, the archery release device 10 is operable by a single user of a plurality of different archery bows having different draw lengths. In switching from bow to bow, such single user adjusts the archery release device 10 to achieve an effective or modified draw length for the applicable bow. In yet another example, the archery release device 10 is operable by a single user of a single archery bow. During different shooting occasions, the single user changes the bowstring angle which, in turn, necessitates a different draw length. Therefore, such single user adjusts the archery release device 10 to achieve an effective or modified draw length for the applicable bowstring angle.

Additional embodiments include any one of the embodiments described above, where one or more of its components, functionalities or structures is interchanged with, replaced by or augmented by one or more of the components, functionalities or structures of a different embodiment described above.

It should be understood that various changes and modifications to the embodiments described herein will be apparent to those skilled in the art. Such changes and modifications can be made without departing from the spirit and scope of the present disclosure and without diminishing its intended advantages. It is therefore intended that such changes and modifications be covered by the appended claims.

Although several embodiments of the disclosure have been disclosed in the foregoing specification, it is understood by those skilled in the art that many modifications and other embodiments of the disclosure will come to mind to which the disclosure pertains, having the benefit of the teaching presented in the foregoing description and associated drawings. It is thus understood that the disclosure is not limited to the specific embodiments disclosed herein above, and that many modifications and other embodiments are intended to be included within the scope of the appended claims. Moreover, although specific terms are employed herein, as well as in the claims which follow, they are used only in a generic and descriptive sense, and not for the purposes of limiting the present disclosure, nor the claims which follow.

The following is claimed:

1. An archery release device comprising:

a body comprising a plurality of finger engagers configured to be oriented so as to face toward a target, wherein the target extends in a plane, wherein the finger engagers comprise an index finger valley, a middle finger valley, and a peak between the index finger and middle finger valleys;

a base pivotally coupled to the body;

a sled supported by the base;

a hook pivotally coupled to the sled, wherein the hook is configured to engage a bowstring;

a hook restrictor supported by the base; and a driver supported by the base, wherein the driver is configured to cause the sled to slide along the base so as to cause the hook to move along an axis relative to the hook restrictor, wherein the axis intersects with the plane when the finger engagers are oriented so as to face toward the target, wherein the movement of the hook is associated with a change in an amount of force necessary for the hook to pivot from: (a) a first position wherein the hook is restricted by the hook restrictor; to (b) a second position wherein the hook is unrestricted by the hook restrictor, resulting in a release of the bowstring.

2. The archery release device of claim 1, wherein:

the base comprises a bottom and a plurality of side walls extending upward from the body; and the base defines a main cavity located between the side walls, wherein the main cavity is configured to receive the sled.

3. The archery release device of claim 1, wherein:

the axis comprises a first axis;

the base comprises a bottom, wherein the bottom defines at least one slot comprising a first diameter and a second diameter that is greater than the first diameter, wherein the second diameter extends along a second axis; and the second axis is parallel to the first axis.

4. The archery release device of claim 3, comprising a fastener configured to be inserted through the at least one slot and secured to the sled, wherein, before the fastener fully secured to the sled, the fastener is configured to be moved between a plurality of fastener positions along the second axis in response to action of the driver.

5. The archery release device of claim 1, wherein:

the axis comprises a first axis;

the base comprises a bottom, wherein the bottom defines at least one cavity comprising a first diameter and a second diameter that is greater than the first diameter, wherein the second diameter extends along a second axis;

the second axis is parallel to the first axis;

the sled comprises a follower configured to be inserted into the at least one cavity; and the driver is configured to engage the follower so as to cause the follower to move within the at least one cavity.

6. The archery release device of claim 1, wherein:

the sled comprises a plurality of side walls, wherein each of the side walls defines a sled opening;

the hook defines a hook opening; and the archery release device comprises a pivot member configured to be inserted through the sled openings and the hook opening so as to pivotally couple the hook to the sled.

7. The archery release device of claim 6, wherein:
the axis comprises a first axis;
the base defines an elongated cavity extending along a second axis that is parallel to the first axis; and
the sled comprises a follower configured to be inserted into the elongated cavity.

8. The archery release device of claim 1, wherein:
the base comprise a base top surface;
the sled comprises a sled bottom and plurality of side walls supported by the sled bottom;
the sled bottom comprises a sled bottom surface; and
the sled bottom surface is configured to slideably interface with the base top surface.

9. The archery release device of claim 1, wherein the driver comprises one of: (a) a plurality of threads; or (b) a gear.

10. An archery release device comprising:
a body comprising a plurality of finger engagers, wherein the finger engagers comprise an index finger valley, a middle finger valley, and a peak between the index finger and middle finger valleys;
a base pivotally coupled to the body, wherein the base comprises a top surface;
a support that is supported by the base, wherein the support comprises:
a bottom comprising a bottom surface configured to slideably interface with the top surface of the base; and
a portion coupled to the bottom;
a bowstring holder pivotally coupled to the portion, wherein the bowstring holder is configured to engage a bowstring; and
a driver supported by the base, wherein the driver is configured to receive an adjustment force and, in response to the adjustment force, cause the support to slide along the base.

11. The archery release device of claim 10, wherein:
the body is configured to be oriented so that the finger engagers face toward a target, wherein the target extends in a plane; and
the support is configured to slide relative to the base along an axis, wherein the axis intersects with the plane.

12. The archery release device of claim 10, wherein the sliding of the support relative to the base results in an adjustment of a draw length associated with the bowstring.

13. The archery release device of claim 10, wherein:
the archery release device comprises a restrictor supported by the base;
the archery release device is adjustable to comprise a plurality of different release sensitivities, wherein each one of the sensitivities is associated with a change in an amount of force necessary for the bowstring holder to pivot from: (a) a first position wherein the bowstring holder is restricted by the restrictor; to (b) a second position wherein the bowstring holder is unrestricted by the restrictor, resulting in a release of the bowstring; and
the sliding of the support relative to the base results in change from one of the release sensitivities to another one of the release sensitivities.

14. The archery release device of claim 13, comprising a fastener configured to secure the support to the base after the support has been slid relative the base.

15. A method for manufacturing an archery release device, wherein the method comprises:
configuring a body to comprise a plurality of finger engagers, wherein the finger engagers comprise an index finger valley, a middle finger valley, and a peak between the index finger and middle finger valleys;
configuring a base so that the base is pivotally coupled to the body, wherein the base comprises a top surface;
configuring a support that is supported by the base, wherein the support comprises:
a bottom comprising a bottom surface configured to slideably interface with the top surface of the base; and
a portion coupled to the bottom;
configuring a bowstring holder so that the bowstring holder is pivotally coupled to the portion, wherein the bowstring holder is configured to engage a bowstring; and
configuring a driver to be supportable by the base, wherein the driver is configured to receive an adjustment force and, in response to the adjustment force, cause the support to slide along the base.

16. The method of claim 15, comprising:
configuring the body so that the body can be oriented so that the finger engagers face toward a target, wherein the target extends in a plane; and
configuring the support to be slid relative to the base along an axis, wherein the axis intersects with the plane.

17. The method of claim 16, wherein the sliding of the support relative to the base results in an adjustment of a draw length associated with the bowstring.

18. The method of claim 15, comprising:
configuring the archery release device to comprise a restrictor supported by the base; and
configuring the archery release device to be adjustable to comprise a plurality of different release sensitivities, wherein each one of the sensitivities is associated with a change in an amount of force necessary for the bowstring holder to pivot from: (a) a first position wherein the bowstring holder is restricted by the restrictor; to (b) a second position wherein the bowstring holder is unrestricted by the restrictor, resulting in a release of the bowstring,
wherein the sliding of the support relative to the base results in change from one of the release sensitivities to another one of the release sensitivities.

19. The method of claim 18, comprising configuring the restrictor to be moveably adjustable relative to the support independent of the sliding of the support relative to the base.

20. The method of claim 15, comprising configuring a fastener to secure the support to the base after the support has been slid relative the base.

* * * * *